US008181460B2

(12) United States Patent
McQuary et al.

(10) Patent No.: US 8,181,460 B2
(45) Date of Patent: May 22, 2012

(54) THERMOACOUSTIC DRIVEN COMPRESSOR

(75) Inventors: Bryan O. McQuary, Kingwood, TX (US); Steve M. Cole, Houston, TX (US)

(73) Assignee: e Nova, Inc., Kingwood, TX (US)

( * ) Notice: Subject to any disclaimer, the term of this patent is extended or adjusted under 35 U.S.C. 154(b) by 552 days.

(21) Appl. No.: 12/378,863

(22) Filed: Feb. 20, 2009

(65) Prior Publication Data

US 2010/0212311 A1 Aug. 26, 2010

(51) Int. Cl.
*F01B 29/08* (2006.01)
*F01B 29/10* (2006.01)

(52) U.S. Cl. ..... 60/516; 60/721; 62/6; 62/467

(58) Field of Classification Search ..... 60/516–517, 60/721, 682; 62/6, 467
See application file for complete search history.

(56) References Cited

U.S. PATENT DOCUMENTS

| | | | | |
|---|---|---|---|---|
| 4,114,380 | A | 9/1978 | Ceperley | |
| 4,623,808 | A | 11/1986 | Beale et al. | |
| 4,644,851 | A | 2/1987 | Young | |
| 4,721,440 | A | 1/1988 | Hurst | |
| 4,756,674 | A | 7/1988 | Miller | |
| 4,781,546 | A | 11/1988 | Curwen | |
| 4,802,332 | A | 2/1989 | Beale | |
| 4,932,313 | A | 6/1990 | Gutknecht | |
| 4,953,366 | A * | 9/1990 | Swift et al. | 62/467 |
| 5,257,915 | A | 11/1993 | Laskaris et al. | |
| 5,275,542 | A | 1/1994 | Terauchi | |
| 5,324,175 | A | 6/1994 | Sorensen et al. | |
| 5,389,844 | A | 2/1995 | Yarr et al. | |
| 5,435,136 | A * | 7/1995 | Ishizaki et al. | 60/517 |
| 5,525,845 | A | 6/1996 | Beale et al. | |
| 5,944,302 | A | 8/1999 | Loc et al. | |
| 5,953,920 | A | 9/1999 | Swift et al. | |
| 6,021,643 | A * | 2/2000 | Swift et al. | 62/6 |
| 6,032,464 | A | 3/2000 | Swift et al. | |
| 6,073,538 | A | 6/2000 | Tomesani | |
| 6,293,184 | B1 | 9/2001 | Unger | |
| 6,305,158 | B1 | 10/2001 | Nakhamkin et al. | |
| 6,314,740 | B1 | 11/2001 | De Blok et al. | |
| 6,560,970 | B1 | 5/2003 | Swift | |
| 6,578,364 | B2 | 6/2003 | Corey | |
| 6,637,211 | B1 | 10/2003 | Swift et al. | |
| 6,644,028 | B1 | 11/2003 | Swift et al. | |
| 6,658,862 | B2 | 12/2003 | Swift et al. | |
| 6,725,670 | B2 | 4/2004 | Smith et al. | |
| 7,081,699 | B2 | 7/2006 | Keolian et al. | |

(Continued)

FOREIGN PATENT DOCUMENTS

WO WO 99/20957 A1 4/1999

OTHER PUBLICATIONS

International Search Report from PCT/US2010/024793, Apr. 22, 2010.

(Continued)

*Primary Examiner* — Hoang Nguyen
(74) *Attorney, Agent, or Firm* — Vinson & Elkins L.L.P.

(57) ABSTRACT

The present disclosure details a thermoacoustic driven compressor having a pressurized housing, which contains within a thermoacoustic engine and a working gas, coupled to a positive displacement reciprocating compressor. The thermoacoustic driven compressor generates scalable compressed air from a given heat source.

20 Claims, 13 Drawing Sheets

U.S. PATENT DOCUMENTS

| | | | |
|---|---|---|---|
| 7,104,055 | B2 | 9/2006 | Matsubara et al. |
| 7,143,586 | B2 | 12/2006 | Smith et al. |

OTHER PUBLICATIONS

Written Opinion from PCT/US2010/024793, Apr. 22, 2010.
Grant, "Investigation of the Physical Characteristics of a Mass Element Resonator," M.S. Thesis, Naval Postgraduate School, Monterey, CA, 1992.
Backhaus and Swift, "Fabrication and Use of Parallel Plate Regenerators in Thermoacoustic Engines," Proc. of the 36th Intersociety Energy Conversion Engineering Conference, CT-41, Savannah, GA, 2001.
Gardner and Swift, "A Cascade Thermoacoustic Engine," J. Acoust. Soc. Am. 114:1905-1919, 2003.
Telesz, "Design and Testing of a Thermoacoustic Power Converter," M.S. Thesis, Georgia Institute of Technology, Atlanta, GA, 2006.

* cited by examiner

THERMOACOUSTIC DRIVEN COMPRESSOR

CROSS-REFERENCE TO RELATED APPLICATIONS

N/A

STATEMENT REGARDING FEDERALLY SPONSORED RESEARCH OR DEVELOPMENT

N/A

THE NAMES OF PARTIES TO A JOINT RESEARCH AGREEMENT

N/A

INCORPORATION-BY-REFERENCE OF MATERIAL SUBMITTED ON A COMPACT DISC

N/A

BACKGROUND OF THE INVENTION

1. Field of the Invention

The present disclosure relates to systems and methods for utilizing a thermoacoustic engine with a positive displacement reciprocating compressor.

2. Background of the Invention

Due to the increasing costs and environmental concerns associated with hydrocarbon-based energy, society has recently shown greater interest in technologies that promote energy efficiency and alternative sources of energy. One technology that shows great promise in both fields is a thermoacoustic prime mover, which converts heat from any source to acoustic energy (i.e., an acoustic pressure wave).

In general, a thermoacoustic engine consists of a hermetically sealed cylinder housing (often referred to as a resonating tube) containing a pressurized noble gas (e.g., helium or argon). Attached to the inner wall of the cylinder housing is the thermoacoustic engine core. Depending on the configuration, the engine core can induce either a standing or traveling pressure wave in the gas medium.

In the standing wave case, the engine core can consist of a stack sandwiched between a hot and cold exchanger. The stack typically is a porous solid spanning both temperature extremes through which gas oscillates. One characteristic of such a stack is that the pores of the stack are similar in size to the thermal penetration depth of the gas. To start the engine, hot and cold sources are applied to the hot and cold exchangers, respectively. The large temperature gradient created between these two exchangers causes the gas in the stack to channel heat from the hot to the cold end (per the Second Law of Thermodynamics). This oscillating expansion and contraction of gas between exchangers is what creates the acoustic pressure wave. The standing wave time phasing characteristics are due to very poor thermal contact between the gas and the stack (e.g., because of large pore size), which allows gas pressure and relative gas displacement oscillations to be in phase with the gas thermal expansion and contraction.

In contrast to a stack-derived thermoacoustic engine core, a traveling wave engine core incorporates a regenerator, which can also be sandwiched between a hot and cold exchanger. The regenerator, just like the stack, is typically a porous solid spanning both temperature extremes through which gas oscillates. However, in this case the pores are usually much smaller than the thermal penetration depth of the gas. The excellent contact between the porous material and the gas provides for more efficient heat transfer. The improved efficiency allows the oscillating gas thermal expansions and contractions to be in phase with the gas pressure and relative gas velocity oscillations. Another differentiating factor is that the regenerator functions as an amplifier of acoustic power. This acoustic power can be provided by a number of devices, including, but not limited to, a torus shaped resonator (see, e.g., U.S. Pat. Nos. 6,032,464 and 6,314,740), and a cascaded stack (see, e.g., U.S. Pat. No. 6,658,862). An alternative means of facilitating traveling wave time phasing with a regenerator is through the use of a bellows (see, e.g., U.S. Pat. No. 7,143,586 B2).

It is also known in the art that the pressure wave of a thermoacoustic prime mover can be used to reciprocate a mass element (e.g., a piston; see Grant, "Investigation of the Physical Characteristics of a Mass Element Resonator", M.S. Thesis, Naval Postgraduate School, Monterey, Calif., 1992, National Technical Information Service ADA251792). Furthermore, an electrodynamic linear alternator can be used to convert this mechanical energy to electrical energy (see, e.g., U.S. Pat. Nos. 4,623,808 and 5,389,844). While much discussion has focused on using this electrical energy for space probes and to a lesser extent grid power, one application that has greater potential is electrical compression. Unfortunately, for larger scale compression purposes, this configuration is not practical due to the cost, complexity, and the large number of linear alternators needed.

A related field to the linear alternator is the linear motor compressor (see, e.g., U.S. Pat. No. 5,257,915). However, this device exhibits similar shortcomings, such as complexity and cost.

Therefore, it is apparent that there exists a need to generate larger volumes of compression on a more economical and robust scale via thermoacoustics.

SUMMARY OF THE INVENTION

The present disclosure provides a thermoacoustic compressor, comprising a first housing having a first end, a second end, an inner wall, and an outer wall, the first housing defining a first cavity, and the second end of the first housing defining a first piston rod aperture, a second housing having a first end, a second end, an inner wall, and an outer wall, the first end of the second housing operably connected to the second end of the first housing, the second housing comprising pressurized gas or fluid and defining a second cavity, and the first end of the second housing defining a second piston rod aperture, a reciprocating piston axially movable within the first and second cavities, the reciprocating piston comprising a compression piston head having a first end, a second end, and an outer wall, the compression piston head disposed in the first cavity, the first end of the compression piston head and the first end of the first housing defining a first variable-volume chamber, and the second end of the compression piston head and the second end of the first housing defining a second variable-volume chamber, a piston rod having a first end and a second end, the first end of the piston rod connected to the second end of the compression piston head, and a resonating piston head having a first end, a second end, and an outer wall, the resonating piston head disposed in the second cavity, the first end of the resonating piston head and the first end of the second housing defining a third variable-volume chamber, and the second end of the resonating piston head and the second end of the second housing defining a fourth variable-volume chamber, the first end of the resonating piston head connected to the second end of the piston rod, a valved intake port and a valved discharge port on the first end of the first housing, a thermoacoustic engine connected to the inner wall of the second housing positioned between the second end of the resonating piston head and the second end of the second housing, and, for example, perpendicular to the resonating piston head and spanning the cross-sectional area of the second housing, a means for inhibiting gas flow between the first and the second housing, a means for providing or delivering heat to the thermoacoustic engine, and a means for removing heat from the thermoacoustic engine.

In certain embodiments, the compression piston head comprises at least a first sealing means disposed between the outer wall of the compression piston head and the inner wall of the first housing. In particular embodiments, the at least a first sealing means of the compression piston head comprises at least a first piston ring disposed within a first groove or seat formed in the outer wall of the compression piston head. In certain aspects, the at least a first piston ring is coated, for example with polytetrafluoroethylene. In further embodiments, the at least a first piston ring is made from metal, for example cast iron, aluminum, or an alloy, a composite material, a plastic material, or a composite plastic material, for example polytetrafluoroethylene, polyetheretherketone, or polyphenylene sulfide, or any combination thereof. In particular aspects, the composite plastic material comprises a filler, for example white glass, glass molybdenum, glass graphite, carbon, polyetheretherketone, bronze, bronze molybdenum, polyphenylene sulfide, molybdenum, or any combination thereof. In other embodiments, the compression piston head further comprises a biasing means disposed within the first groove for forcing the at least a first piston ring against the inner wall of the first housing.

In certain embodiments, the thermoacoustic compressor further comprises a guiding means for guiding the compression piston head in the first cavity. In particular aspects, the guiding means comprises at least a first guide ring disposed within a second groove formed in the outer wall of the compression piston head. In further embodiments, the at least a first guide ring is coated, for example with polytetrafluoroethylene. In other embodiments, the at least a first guide ring is made from metal, for example cast iron, aluminum, or an alloy, a composite material, a plastic material, or a composite plastic material, for example polytetrafluoroethylene, polyetheretherketone, or polyphenylene sulfide, or any combination thereof. In certain aspects, the composite plastic material comprises a filler, for example white glass, glass molybdenum, glass graphite, carbon, polyetheretherketone, bronze, bronze molybdenum, polyphenylene sulfide, molybdenum, or any combination thereof.

In particular embodiments, the compression piston head is coated, for example with polytetrafluoroethylene. In other embodiments, the compression piston head is lubricated, for example oil lubricated. In these embodiments, the compression piston head may further comprise a means for removing lubricant from the inner wall of the first housing, for example at least a first scraper ring, which may be disposed within a third groove formed in the outer wall of the compression piston head. In certain embodiments, the thermoacoustic compressor further comprises a collection chamber located proximal to the second end of the first housing. In these embodiments, the first housing may further comprise a pressure lubricating system, which in certain aspects may comprise a pump, a filter, a lubricant line, a lubricant dispenser, a spray nozzle, or any combination thereof.

In certain aspects, the first housing, second housing, and/or reciprocating piston is made from metal, for example iron, cast iron, nodular cast iron, ductile iron, gray iron, aluminum, steel, cast steel, forged steel, stainless steel, for example 304, 316, 316L, 316H, 410, or 419 stainless steel, carbon steel, bronze, an alloy, for example a nickel-based alloy, such as a 625 alloy, an INCONEL® alloy, or an INCONEL® 625 alloy, or a combination thereof. In further embodiments, the inner wall of the first housing is coated, for example with polytetrafluoroethylene. In other aspects, the first housing further comprises a cooling means, for example at least a first water jacket located around the first housing, at least a first water jacket located in a cavity between the inner wall and the outer wall of the first housing, and/or at least a first air fin located on the outer wall of the first housing.

In particular aspects, the thermoacoustic compressor further comprises a displacement control and return means within the first housing, which in certain aspects may comprise at least a first mechanical spring located between the second end of the compression piston head and the second end of the first housing, or a variable-volume balance chamber within the first housing located between the second end of the compression piston head and the second end of the first housing. In these aspects, the thermoacoustic compressor may further comprise a porting means, for example a groove in the inner wall of the first housing, in fluid communication between the variable-volume balance chamber and the variable-volume compression chamber, or further comprise a mechanical spring disposed in a groove in the inner wall of the variable-volume balance chamber between the second end of the compression piston head and the second end of the first housing.

In certain embodiments, the means for inhibiting gas flow between the first and the second housings is a seal disposed about the piston rod and located in the first piston rod aperture or the second piston rod aperture. In particular aspects, the seal comprises packing, for example an oil wiper or pressure packing, which may be cooled, for example water cooled or cooled using a heat conducting sleeve, such as a Thermosleeve™. In these aspects, the thermoacoustic compressor may further comprise a purging line connected to the oil wiper or pressure packing and a purging canister, which may comprise the same pressurized gas as the second housing, connected to the purging line comprising pressurized gas or fluid, or may further comprise a venting line connected to the oil wiper or pressure packing and extending to an environment external of the first or second housing. In further embodiments, the venting line extends through the outer wall of the first or second housing.

In other embodiments, the first and/or second housing comprises at least a first lubricating strip between the first and/or second housing and the piston rod. In further embodiments, the second housing further comprises a displacement control and return means, which may comprise at least a first mechanical spring located between the first end of the resonating piston head and the first end of the second housing, or a variable-volume balance chamber within the second housing located between the first end of the resonating piston head and the first end of the second housing, in which case the thermoacoustic compressor may further comprise a mechanical spring disposed in a groove in the inner wall of the variable-volume balance chamber between the first end of the resonating piston head and the first end of the second housing. In yet other embodiments, the inner wall of the second housing and/or resonating piston head is coated, for example with polytetrafluoroethylene. In still other embodiments, the resonating piston head is tightly fitted within the second cavity.

In further embodiments, the resonating piston head comprises at least a first piston ring disposed within a first groove formed in the outer wall of the resonating piston head. In certain embodiments, the at least a first piston ring is a piston sealing or guide ring. In particular aspects, the at least a first piston ring is coated, for example with polytetrafluoroethylene. In other embodiments, the at least a first piston ring is made from metal, for example cast iron, aluminum, or an alloy, a composite material, a plastic material, or a composite plastic material, for example polytetrafluoroethylene, polyetheretherketone, or polyphenylene sulfide, or any combination thereof. In yet other embodiments, the composite plastic material comprises a filler, which may comprise white glass, glass molybdenum, glass graphite, carbon, polyetheretherketone, bronze, bronze molybdenum, polyphenylene sulfide, molybdenum, or any combination thereof. In additional embodiments, the resonating piston head further comprises a biasing means disposed within a first groove formed in the outer wall of the resonating piston head for forcing the at least a first piston ring against the inner wall of the second housing.

In certain embodiments, the means for providing or delivering heat to the thermoacoustic engine comprises heating metal wiring. In other embodiments, the means for providing or delivering heat to the thermoacoustic engine comprises a heated fluid and piping. In such embodiments, the means for providing or delivering heat to the thermoacoustic engine may further comprise a pump, may further comprise a heat recovery or exchanger unit, which may comprise pumping a heated fluid through piping from a heat recovery or exchanger unit. In further embodiments, the means for removing heat from the thermoacoustic engine comprises cooling fluid and piping. In these embodiments, the means for removing heat from the thermoacoustic engine may further comprise a pump, and further comprise a heat recovery or exchanger unit, which may comprise pumping a cooling fluid through piping to a heat recovery or exchanger unit. In yet other embodiments, the means for removing heat from the thermoacoustic engine further comprises at least a first fan.

In particular aspects, the thermoacoustic compressor further comprises a dehumidifying means, for example a scrubber, a desiccant dryer, or a refrigeration means, such as thermoacoustic or Stirling refrigeration, in fluid communication with the valved discharge port. In other aspects, the thermoacoustic compressor further comprises an intercooler in fluid communication with the valved discharge port, a pulsation tube in fluid communication with the valved discharge port, and/or a lubricant removing means, which may comprise a coalescer, in fluid communication with the valved discharge port. In further aspects, the thermoacoustic compressor further comprises a means for storing compressed fluid in fluid communication with the valved discharge port, and/or a heating means, for example a heat recovery unit or a heat exchanger, in fluid communication with the valved discharge port. In still further aspects, the thermoacoustic compressor further comprises a filter in fluid communication with the valved intake port, and/or a refrigeration means, for example thermoacoustic or Stirling refrigeration, in fluid communication with the valved intake port.

In certain embodiments, the thermoacoustic engine comprises a thermoacoustic core. In such embodiments, the thermoacoustic core may comprise a hot exchanger, which may comprise a shell-and-tube or finned-tube design, a cold exchanger, which may comprise a shell-and-tube or finned-tube, or circulating heat exchanger design, and a stack. In particular embodiments, the hot and/or cold exchanger is made from metal, for example stainless steel, such as 304 stainless steel, 316 stainless steel, 316L stainless steel, 316H stainless steel, 409 stainless steel, or 419 stainless steel, or a combination thereof, carbon steel, aluminum, an alloy, for example a nickel-based alloy, a nickel-based 625 alloy, or an INCONEL® 625 alloy, copper, tellurium copper, oxygen-free high conductivity copper, or a combination thereof. In further embodiments, the stack comprises a honeycomb, stacked screen, parallel-plate, random fiber, foam, foil roll/stack, or packed sphere design. In other aspects, the stack is made from carbon nanotubes, a ceramic, a composite, glass, metal hydrides, phase exchange materials, nanoparticles, or metal, such as stainless steel, carbon steel, aluminum, an alloy, or a combination thereof. In other such embodiments, the thermoacoustic engine core may comprise a hot exchanger, a cold exchanger, and a regenerator. In these embodiments, the hot exchanger may be downstream of the regenerator. In certain aspects, the regenerator comprises a honeycomb, stacked screen, or parallel-plate design. In other aspects, the regenerator is made from carbon nanotubes or metal, for example stainless steel, carbon steel, aluminum, an alloy, or a combination thereof.

In particular embodiments, the second housing comprises or defines a torus, which may define an acoustic compliance portion and an inertance portion, which may comprise a polished inside surface and/or a pressure balancing sliding joint. In these embodiments, the thermoacoustic compressor may further comprise a max flux suppressor within the torus, and/or a thermal buffer tube adjacent to the hot exchanger opposite the regenerator. In certain aspects, the thermal buffer tube is made from carbon nanotubes or metal, such as stainless steel, carbon steel, aluminum, an alloy, or a combination thereof. In other aspects, the thermal buffer tube comprises a polished inside surface, at least a first flow straightener, and/or is tapered. In yet other aspects, the length of the thermal buffer tube is greater than the peak-to-peak fluid displacement amplitude. In certain embodiments, the thermoacoustic engine further comprises an ambient heat exchanger for residual heat leaks, and/or further comprises a bellows.

In certain embodiments, the resonating and/or compression piston head is flat, truncated cone-shaped, shaped like the cross-section of an isosceles trapezoid, hemi-elliptical shaped, or a combination thereof. In particular embodiments, the resonating and/or compression piston head is solid or hollow. In other embodiments, the thermoacoustic compressor further comprises a second valved intake port and a second valved discharge port on the second end of the first housing. In still other embodiments, the first end of the second housing is physically mated to the second end of the first housing.

In additional embodiments, the thermoacoustic compressor further comprises a third housing having a first end, a second end, an inner wall, and an outer wall, the first end of the second housing operably connected to the second end of the third housing, the second end of the first housing operably connected to the first end of the third housing, the third housing defining a third cavity, the first end of the third housing defining a third piston rod aperture, and the second end of the third housing defining a fourth piston rod aperture. In particular aspects, the third housing further comprises a displacement control and return means, which may comprise at least a first mechanical spring, at least a first gas spring, or at least a first mechanical spring and at least a first gas spring. In further aspects, the third housing is made from metal, for example iron, cast iron, nodular cast iron, aluminum, steel, cast steel, forged steel, stainless steel, carbon steel, bronze, an alloy, or a combination thereof. In other aspects, the inner wall of the third housing is coated, for example with polytetrafluoroethylene. In yet other aspects, the inner wall of the third housing comprises a cylinder liner, for example a replaceable cylinder liner. In still other aspects, the cylinder liner is coated, for example with polytetrafluoroethylene. In certain aspects, the third housing comprises at least a first sealable access hole.

In other embodiments, the second housing further comprises a plurality of thermoacoustic engines in series. In certain embodiments, the second housing further comprises at least one region of high specific acoustic impedance in an acoustic wave. In such embodiments, the second housing may further comprise a plurality of thermoacoustic engines in series within the at least one region of high specific acoustic impedance. In particular embodiments, the at least a first of the plurality of thermoacoustic engines is a stack and at least a second of the plurality of thermoacoustic engines is a regenerator. In other embodiments, the second housing defines a first area having a first cross-sectional area and a second area having a second cross-sectional area. In such embodiments, the cross-sectional area of the first cross-sectional area may be the same or different than the cross-sectional area of the second cross-sectional area. In yet other embodiments, the second housing further defines a third area having a third cross-sectional area between the first area having a first cross-sectional area and the second area having a second cross-sectional area, thereby creating a plurality of regions of high acoustic impedance. In still other embodiments, the thermoacoustic compressor comprises a thermal buffer tube adjacent to at least one of the plurality of thermoacoustic engines. In certain aspects, the thermal buffer tube is tapered, while in other aspects the thermal buffer tube connects a first and a second of the plurality of thermoacoustic engines. In further aspects, the second housing comprises a plurality of regions of high specific acoustic impedance along a common axis. In such aspects, the at least a first of the plurality of regions of high specific acoustic impedance may comprise a plurality of thermoacoustic engines in series and at least a second of the plurality of regions of high specific acoustic impedance comprises a plurality of thermoacoustic engines in series, or the at least a first and at least a second of the plurality of regions of high specific acoustic impedance may be separated by an acoustic side branch, thereby creating an axially extended region of high acoustic impedance.

In further embodiments, the first, second, and/or third housing comprises at least a first sealable access hole. In other embodiments, the first, second and third housing each comprise at least a first sealable access hole. In particular embodiments, the inner wall of the first, second, and/or third housing comprises a cylinder liner, for example a replaceable cylinder liner and/or a coated cylinder liner. In other embodiments, the intake and/or discharge valve is corrosion resistant, for example the intake valve may be made from stainless steel.

In certain aspects, the thermoacoustic compressor further comprises a gas or fluid bearing disposed in a clearance gap between the outer wall of the compression piston and the inner wall of the first housing, while in other aspects the thermoacoustic compressor further comprises a gas or fluid bearing disposed in a clearance gap between the outer wall of the resonating piston and the inner wall of the second housing. In particular aspects, the thermoacoustic compressor further comprises a first gas or fluid bearing disposed in a clearance gap between the outer wall of the compression piston and the inner wall of the first housing and a second gas or fluid bearing disposed in a clearance gap between the outer wall of the resonating piston and the inner wall of the second housing.

In other embodiments, the thermoacoustic compressor further comprises a third housing having a first end, a second end, an inner wall, and an outer wall, the third housing defining a third cavity, the second end of the third housing operably connected to the first end of the first housing, and the second end of the third housing defining a third piston rod aperture, a second compression piston head having a first end, a second end, and an outer wall, the second compression piston head disposed in the third cavity, the first end of the second compression piston head and the first end of the third housing defining a fifth variable-volume chamber, and the second end of the second compression piston head and the second end of the third housing defining a sixth variable-volume chamber, a second piston rod having a first end and a second end, the first end of the second piston rod connected to the first end of the compression piston head, and the second end of the second piston rod connected to the second end of the second compression piston head, and a second valved intake port and a second valved discharge port on the first end of the third housing. In certain embodiments, the size of the third housing is the same or different from the size of the first housing. In further embodiments, the valved discharge post of the first housing is in fluid communication with the second valved intake port of the third housing. In such embodiments, the thermoacoustic compressor may further comprise an intercooler in fluid communication with the valved discharge port.

The present disclosure also provides a multistage thermoacoustic compressor, comprising a first thermoacoustic compressor and a second thermoacoustic compressor, wherein the valved discharge port of the first thermoacoustic compressor is in fluid communication with the valved intake port of the second thermoacoustic compressor. In certain embodiments, the multistage thermoacoustic compressor further comprises an intercooler in fluid communication with the valved discharge port of the first thermoacoustic compressor. In particular embodiments the first thermoacoustic compressor is vertically aligned with the second thermoacoustic compressor, while in other embodiments the first thermoacoustic compressor is horizontally aligned with the second thermoacoustic compressor.

The present disclosure further provides a thermoacoustic compressor comprising a first housing having a first end, a second end, an inner wall, and an outer wall, the first housing defining a first cavity, and the second end of the first housing defining a first piston rod aperture, a second housing having a first end, a second end, an inner wall, and an outer wall, the first end of the second housing operably connected to the second end of the first housing, the second housing comprising pressurized gas or fluid and defining a second cavity, and the first end of the second housing defining a second piston rod aperture, a third housing having a first end, a second end, an inner wall, and an outer wall, the second end of the third housing operably connected to the first end of the first housing, the third housing comprising pressurized gas or fluid and defining a third cavity, and the second end of the third housing defining a third piston rod aperture, a reciprocating piston axially movable within the first and second cavities, the reciprocating piston comprising, a compression piston head having a first end, a second end, and an outer wall, the compression piston head disposed in the first cavity, the first end of the compression piston head and the first end of the first housing defining a first variable-volume chamber, and the second end of the compression piston head and the second end of the first housing defining a second variable-volume chamber, a first piston rod having a first end and a second end, the first end of the first piston rod connected to the second end of the compression piston head, a first resonating piston head having a first end, a second end, and an outer wall, the first resonating piston head disposed in the second cavity, the first end of the first resonating piston head and the first end of the second housing defining a third variable-volume chamber, and the second end of the first resonating piston head and the second end of the second housing defining a fourth variable-volume chamber, the first end of the first resonating piston head connected to the second end of the first piston rod, a second piston rod having a first end and a second end, the second end of the second piston rod connected to the first end of the compression piston head, and a second resonating piston head having a first end, a second end, and an outer wall, the second resonating piston head disposed in the third cavity, the first end of the second resonating piston head and the first end of the third housing defining a fifth variable-volume chamber, and the second end of the second resonating piston head and the second end of the third housing defining a sixth variable-volume chamber, the second end of the second resonating piston head connected to the first end of the second piston rod, a first valved intake port and a first valved discharge port on the first end of the first housing, a first thermoacoustic engine connected to the inner wall of the second housing positioned between the second end of the first resonating piston head and the second end of the second housing, a second thermoacoustic engine connected to the inner wall of the third housing positioned between the first end of the second resonating piston head and the first end of the third housing, a means for inhibiting gas flow between the first and the second housing, a means for inhibiting gas flow between the first and the third housing, a means for providing or delivering heat to the first thermoacoustic engine, a means for providing or delivering heat to the second thermoacoustic engine, a means for removing heat from the first thermoacoustic engine, and a means for removing heat from the second thermoacoustic engine. In certain embodiments, the thermoacoustic compressor further comprises a second valved intake port and a second valved discharge port on the second end of the first housing. In other embodiments, the thermoacoustic compressor further comprises a starting mechanism connected to the first housing.

The present disclosure additionally provides a method of compressing a fluid or gas, comprising, introducing a fluid or gas through the valved intake port of a thermoacoustic compressor into the first variable-volume chamber of the first cavity, and running the thermoacoustic compressor, thereby compressing the fluid or gas. In certain embodiments, the fluid or gas is filtered and/or refrigerated prior to introduction into the first variable-volume chamber. In particular embodiments, the compressed fluid or gas is released from the first variable-volume chamber through the valved discharge port. In further embodiments, the compressed fluid or air is stored after release from the first variable-volume chamber. In other embodiments, the compressed fluid or gas is cooled or heated after release through the valved discharge port. In yet other embodiments, the compressed fluid or gas is introduced into a compression chamber of a second thermoacoustic compressor.

In additional embodiments, the compressed fluid or gas is introduced into a separate mechanical device, such as a gas turbine, an expander attached to an electrical generation system, an expander connected to a gas turbine power shaft, or a reciprocating engine. In further embodiments, heat is provided to the thermoacoustic engine from a separate mechanical device, for example waste heat generated by the separate mechanical device. In other embodiments, heat is provided to the thermoacoustic engine from a separate industrial process, for example waste heat generated by the separate industrial process. In particular embodiments heat is provided to the thermoacoustic engine from a separate alternative energy process, for example waste heat generated by the separate alternative energy process.

It is to be understood that both the foregoing general description and the following detailed description are exemplary and explanatory only, and are not restrictive of the invention, as claimed. In this application, the use of the singular includes the plural, the word "a" or "an" may mean a singular object or element, or it may mean a plurality, at least one, or one or more of such objects or elements, and the use of "or" means "and/or", unless specifically stated otherwise. Throughout this disclosure, unless the context dictates otherwise, the word "comprise" or variations such as "comprises" or "comprising," is understood to mean "includes, but is not limited to" such that other elements that are not explicitly mentioned may also be included. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise.

The section headings used herein are for organizational purposes only and are not to be construed as limiting the subject matter described and claimed. All documents, or portions of documents, cited in this application, including, but not limited to, patents, patent applications, articles, books, and treatises, are hereby expressly incorporated herein by reference in their entirety for any purpose. In the event that one or more of the incorporated literature and similar materials defines a term in a manner that contradicts the definition of that term in this application, this application controls.

BRIEF DESCRIPTION OF THE DRAWINGS

The following drawings are included to further demonstrate certain aspects and embodiments of the present invention. The invention may be better understood by reference to one or more of these drawings in combination with the detailed description of specific embodiments presented herein.

FIG. 4A. A horizontal cross section through one embodiment of a single-acting non-lubricated compression piston head. FIG. 4B. A partial horizontal cross section through one embodiment of a single-acting non-lubricated compression piston head using a gas bearing system. FIG. 4C. A horizontal cross section through one embodiment of a resonating piston head using a gas bearing system.

FIG. 7A. A horizontal cross section through one embodiment of a double-acting non-lubricated thermoacoustic driven compressor incorporating a torus-derived thermoacoustic engine and tandem resonator at both ends of the compression piston head. FIG. 7B. A horizontal cross section through one embodiment of a double-acting/single-acting non-lubricated/lubricated compression piston head.

FIG. 12A. Schematic of a first horizontal orientation for single or multi-stage thermoacoustic compressors. FIG. 12B. Schematic of a second horizontal orientation for single or multi-stage thermoacoustic compressors.

DETAILED DESCRIPTION OF THE INVENTION

The present disclosure provides for a thermoacoustic driven compressor ("TADC") that can utilize a heat driven standing or traveling wave thermoacoustic engine of any variation (e.g., requiring the use of a stack, regenerator, torus, hybrid (e.g., cascade), bellows, or any variation thereof), to power any type of reciprocating compressor or pump. A general discussion follows of exemplary TADCs containing three housings. These housings (thermoacoustic, distance, and compression) can have multiple mating surfaces and means of connecting mating surfaces to each other and/or to other structures. These housings can also be different sizes, vary in shape, and be separate from each other. It will be understood that the following discussion is not meant to be limiting, and that a TADC with greater or fewer housings or multiple components (from thermoacoustic, distance, compression, etc.) combined under one housing are within the scope of the present invention. It will also be understood that TADC housings can be formed from multiple components mated together. Finally, it will be understood that a TADC can be non-lubricated, lubricated, single-acting, double-acting, single-stage, multi-stage, and can incorporate tandem compression pistons and rods and/or a tandem resonating piston with accompanying piston rod and thermoacoustic engine(s).

Figure 1:
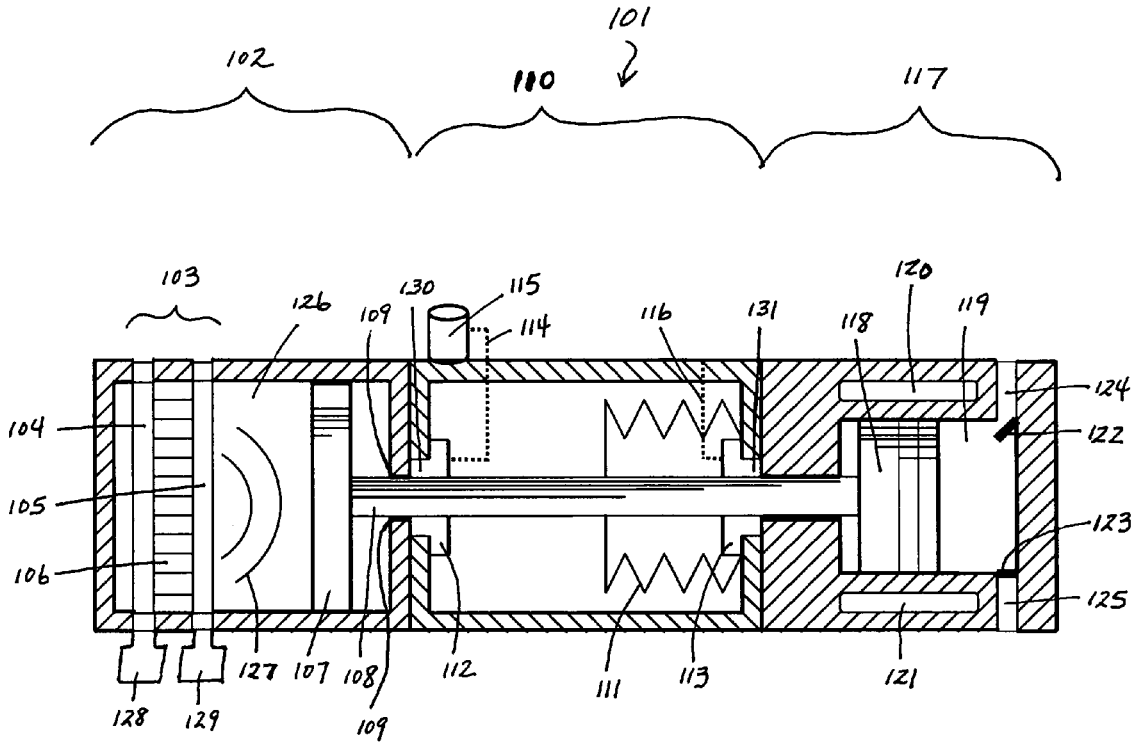
FIG. 1. A horizontal cross section through one embodiment of a single-acting non-lubricated thermoacoustic compressor.

Referring to the figures, FIG. 1 demonstrates one embodiment of a single-acting non-lubricated TADC 101 comprised of a thermoacoustic 102, distance 110, and compression 117 housing. The thermoacoustic housing (resonating tube) 102 contains a pressurized compressible working fluid/gas 126. Supported inside the thermoacoustic housing 102 is a thermoacoustic engine core 103, which in this embodiment includes a hot exchanger 104, a cold exchanger 105, and a stack 106. When the hot exchanger 104 and cold exchanger 105 are connected to a hot source 128 and cold source 129, respectively, a temperature differential is created between the two exchangers, and the stack 106 facilitates this process. This temperature gradient enables the thermoacoustic engine to generate an acoustic pressure wave 127 via the working fluid/gas medium 126. Said another way, the pressurized working fluid/gas 126 expands and contracts within the stack 106, moving heat from the hot exchanger 104 to the cold exchanger 105. In so doing, the oscillating gas 126 exhibits standing wave time phasing characteristics 127. This oscillating kinetic energy (e.g., an acoustic pressure wave) is converted to mechanical energy by means of a resonating piston head 107, which can have seated sealing and/or guiding rings (not shown), reciprocates linearly, and is connected to a piston rod 108. In embodiments where pressure/lubrication packing is not used (pressure/lubrication packing discussed in detail below), at locations where the piston rod 108 interacts with any of the housings lubricating strips 109 can be attached to the housing to reduce friction.

The distance housing 110 contains a continuation of the linearly reciprocating piston rod 108. As a means of controlling displacement, return, and centering of the piston assembly, one or more springs 111 can be incorporated in the distance housing 110. The springs 111 can be mechanical (e.g., helix, double helix, or planar), gas, magnetic, or a combination thereof. Pressure packings 112 and 113, or any other type of seal, can be set about the piston rod 108 and piston rod apertures 130 and 131 at both ends of the distance housing 110 to inhibit gas/fluid leakage from the thermoacoustic housing 102 and compression housing 117 via the piston rod 108. For the side of the distance housing 110 facing the thermoacoustic housing 102, a purging line 114 and canister 115 can be incorporated with pressure packing 112. The canister 115 can contain the same gas as that in the thermoacoustic housing 102, albeit at a higher pressure (gas used to expand rings in pressure packing, thereby providing a better seal) and can be attached to the exterior of the housing 110. For the side of the distance housing 110 facing the compression housing 117, a tube 116 may be attached to pressure packing 113 to vent residual compressed gas, although a purging line and canister could also be used (see FIG. 2).

The compression housing 117 contains the compression piston head 118, piston sealing and/or guide rings (not shown), a cavity or compression chamber 119, the remaining portion of the linearly reciprocating piston rod 108, water jackets 120 and 121 (optional; could also use air fins together or separately (not shown)), gas/fluid inlet valve 122, gas/fluid discharge valve 123, gas/fluid inlet port 124, and gas/fluid discharge port 125. As the compression piston head 118 is interconnected by means of piston rod 108, the oscillating acoustic force applied to the resonating piston head 107 propels the compression piston head 118 forward (to the right in FIG. 1). As a result, the process gas/fluid in the compression chamber 119 is compressed. When the pressure in the compression chamber exceeds the discharge pressure, the process gas/fluid is released via the discharge valve 123. On the return stroke, in this case due to springs 111, the one-way inlet valve 122 opens so that new process gas/fluid can enter the compression chamber.

Figure 2:
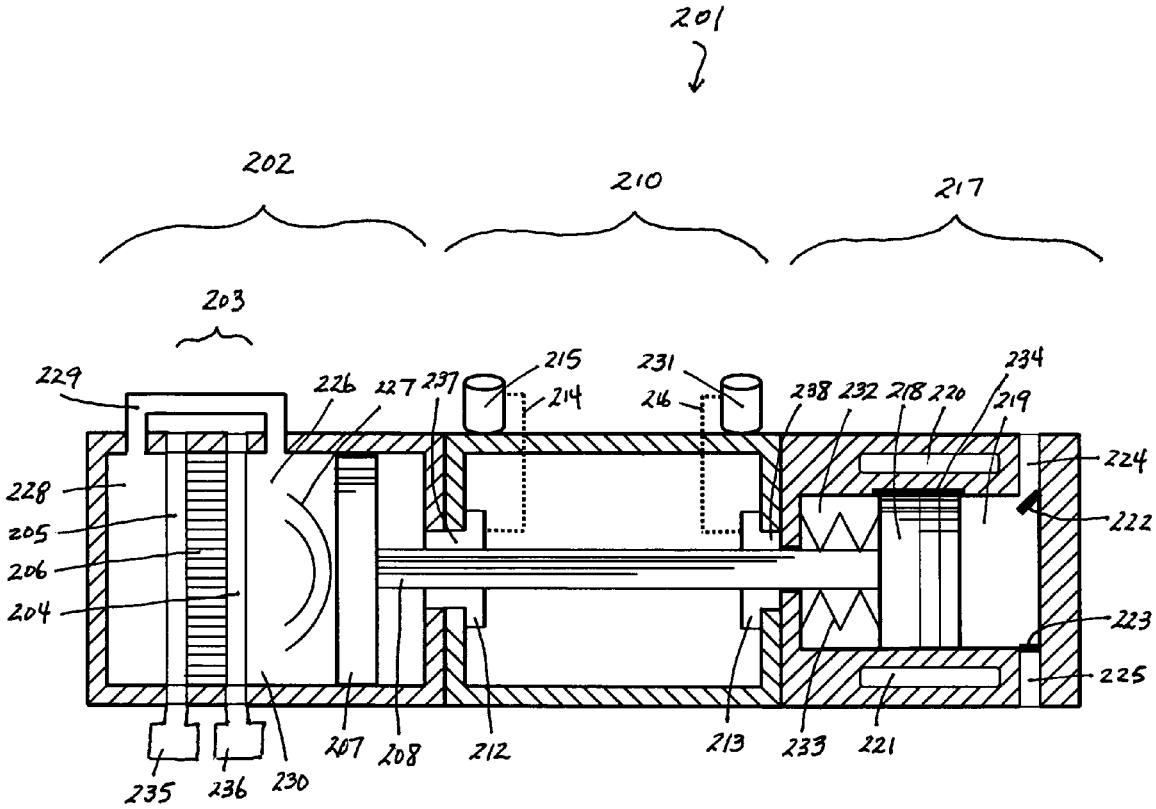
FIG. 2. A horizontal cross section through one embodiment of a single-acting non-lubricated thermoacoustic compressor incorporating a means of return behind the compression piston head.

FIG. 2 shows another embodiment of a single-acting non-lubricated TADC 201. In this example, the thermoacoustic housing 202 (resonating tube) once again comprises a pressurized compressible working fluid/gas 226, and incorporates a regenerator 206, in lieu of a stack, in the thermoacoustic engine core 203. Additionally, the thermoacoustic housing 202 is of a torus configuration that incorporates a compliance portion 228 and an inertance tube 229. In traveling wave embodiments, the cold exchanger 205 is to the left of the hot exchanger 204 (with the cold exchanger 205 upstream of the regenerator 206). When the hot exchanger 204 and cold exchanger 205 are connected to a hot source 236 and cold source 235, respectively, a temperature differential is created between the two exchangers. This temperature differential enables the regenerator 206 to amplify incoming acoustic power. This amplified acoustic power with traveling wave phasing 227 is then pumped out of the hot exchanger 204 and used to drive the linearly resonating piston head 207 (sealing and/or guiding rings not shown), which is connected to a piston rod 208, and provide new acoustic power to the cold exchanger 205 via the inertance tube 229 and compliance portion 228. One or more thermal buffer tubes ("TBT") 230 can also be incorporated adjacent to the hot exchanger 204 at multiple locations, thereby mitigating heat leaks (and corresponding efficiency loss) from the hot exchanger to ambient. The regenerator 206 provides the same thermal isolation on the opposite side.

The distance housing 210 contains a continuation of the linearly reciprocating piston rod 208. Additionally, pressure packing 212, with an accompanying purging canister 215 and a purging line 214, can be set about the piston rod 208 and the distance housing piston rod aperture 237 facing the thermoacoustic housing, and pressure packing 213, with an accompanying purging canister 231 and a purging line 216, can be set about the piston rod 208 and the distance housing piston rod aperture 238 facing the compression housing.

The compression housing 217 contains the compression piston head 218, piston seals and/or guiding rings (not shown), a cavity or compression chamber 219, the remaining portion of the linearly reciprocating piston rod 208, water jackets 220 and 221 (optional), gas/fluid inlet valve 222, gas/fluid discharge valve 223, gas/fluid inlet port 224, and gas/fluid discharge port 225. A spring can be incorporated in the compression housing 217 as a means of controlling displacement, return, and centering of the compression piston head. This spring can be a balance chamber 232 (gas spring), which is located behind the compression piston 218, one or more mechanical springs 233, and a porting mechanism 234 (one-way valve optional—not shown), or any combination thereof. The gas spring 232 and mechanical spring 233 can be used to prevent the compression piston head 218 from contacting either end of the inner surface of the compression housing 217. The porting mechanism 234 (e.g., a groove) allows the compression chamber 219 and balance chamber 232 to communicate during reciprocation of the compression piston head 218, thereby further enabling the compression piston head 218 to stay centered. As the compression piston head 218 is interconnected by means of piston rod 208, the oscillating acoustic force applied to the resonating piston head 207 propels the compression piston head 218 forward (to the right in FIG. 2). As a result, the process gas/fluid in the compression chamber 219 is compressed. When the pressure in the compression chamber exceeds the discharge pressure, the process gas/fluid is released via the discharge valve 223. On the return stroke, in this case due to springs 232 and 233, the one-way inlet valve 222 opens so that new process gas/fluid can enter the compression chamber.

While not shown in the above mentioned figures, a cascaded derived thermoacoustic engine or any variation/hybrid thereof could also be used to power a non-lubricated single acting TADC. Furthermore, all of the above mentioned compressors can incorporate a second set of valved inlet and discharge ports, thereby allowing process gas/fluid to be compressed on both the forward and backward motion of the piston (double-acting).

The thermoacoustic housing can be fabricated from various materials including, but not limited to, ceramics, composites, aluminum, steel, cast steel, forged steel, stainless steel (e.g., 304, 316, 316H, 316L, 410, 419), carbon steel, alloys, including, but not limited to, nickel-based alloys (e.g., INCONEL® alloys), including, but not limited to, alloy 625, or any combinations thereof. While the resonating tube is cylindrical as shown, other shapes are possible, and the resonating tube can contain multiple sealable access holes. An oscillating side-branch (see, e.g., U.S. Pat. No. 6,560,970) may also be added to the thermoacoustic housing.

The working fluid or gas can be selected from any number of known fluids or gases, including, but not limited to, inert gases, such as helium and argon. In general, the working fluid or gas should have a high speed of sound, high thermal conductivity, a low Prandtl number, and be non-flammable.

In the thermoacoustic engine core, the hot exchanger and cold exchanger can take a variety of forms, including, but not limited to, shell-and-tube or finned-tube, or circulating heat exchanger design (see, e.g., U.S. Pat. No. 6,637,211), be in any order (in the case of a standing wave), have multiple units, and made from materials including, but not limited to, aluminum, aluminum alloy 6061, steel, cast steel, forged steel, stainless steel (e.g., 304, 316, 316H, 316L, 410, 419), carbon steel, alloys, including, but not limited to, nickel-based alloys (e.g., INCONEL® alloys), including, but not limited to, alloy 625, copper, oxygen-free high conductivity ("OFHC") copper, tellurium copper, or any combination thereof. The stack and regenerator can also take a variety of forms, including, but not limited to, a honeycomb, stacked screen, parallel-plate, random fiber, foam, foil roll/stack, or packed spheres design, and can be made from materials including, but not limited to, aluminum, ceramic, composite, glass, metal hydrides, phase change materials, nanoparticles, carbon nanotubes, stainless steel (e.g., 304, 316, 316L, 316H, 410, and 419), carbon steel, and alloys, including, but not limited to, nickel-based alloys (e.g., INCONEL® alloys), including, but not limited to, alloy 625, or any combination thereof.

Additional thermoacoustic housing components can include TBT, which can be made from materials including, but not limited to, aluminum, steel, cast steel, forged steel, stainless steel (e.g., 304, 316, 316L, 316H, 410, and 419), carbon steel, and alloys, including, but not limited to, nickel-based alloys (e.g., INCONEL® alloys), including, but not limited to, alloy 625, or any combination thereof. The length of the TBT should be greater than the peak-to-peak displacement of the gas at high amplitude, and the inside surface of the TBT can also be polished. The TBT can include at least one flow straightener and/or tapering, which mitigates Rayleigh streaming (see, e.g. U.S. Pat. No. 5,953,920). If an inertance tube is required, the inside surface can be polished, and a pressure balancing sliding joint can be included to reduce stress due to thermal expansion. A max flux suppressor (e.g., jet pump) can also be incorporated in the resonator to mitigate Gedeon streaming (see, e.g., U.S. Pat. No. 6,032,464). Further embodiments can include an additional ambient exchanger for residual heat leakage and multiple tori mated together in various ways. Iterations incorporating any single component (or different combinations) are also possible.

The resonating piston can have various shapes, including, but not limited to, flat, truncated cone, cross-section of an isosceles trapezoid, concave, convex, or hemi-ellipses, can also have a variety of sizes, can be hollow, and can be made from the same materials as the thermoacoustic housing. Both the resonating piston and thermoacoustic housing cylinder liner can be coated with an anti-friction compound, such a thermoplastic polymer. While not shown in the above mentioned figures, sealing and/or guidance rings, which can also be coated with an anti-friction compound, can be seated in the resonating piston head. Rings can be any size, cut (e.g., angle, step, and butt), style (e.g., pressure balanced, single, and multi-segment), and made from any suitable composite plastic material (i.e. thermoplastic polymer), including, but not limited to, polytetrafluoroethylene ("PTFE"), polyetheretherketone ("PEEK"), and/or polyphenylene sulfide ("PPS"). The composite plastic material can also use fillers including, but not limited to, white glass, glass molybdenum ("glass moly"), glass graphite, carbon, PEEK, bronze, bronze molybdenum ("bronze moly"), PPS, molybdenum, and in any combination thereof. As an alternative to piston and/or guide rings, the resonating piston head/thermoacoustic housing could also incorporate a gas/fluid bearing, which can be of a design including, but not limited to, hydrostatic, hydrodynamic, or any combination thereof (discussed below). Replaceable cylinder liners can also be used with the resonating and/or compression piston head. While not shown, a means of piston displacement control and return, which can include, but is not limited to, one or more springs (gas, mechanical, or any combination thereof), can set between the resonating piston and the piston rod aperture (or any other location in the thermoacoustic housing); a valved porting means may also be incorporated.

Pressure packing, lubrication wiper packing, or any other type of seal, can be set around the piston rod where the rod penetrates the thermoacoustic housing, compression housing, and/or distance housing (or in any other location). The packing can also abut or penetrate the apposing housing. A purging canister, which can contain the same gas as that in the thermoacoustic housing, purging line, and/or venting tube can also be included. The pressure packing can be of the water-cooled or non-water-cooled variety (e.g., Thermosleeve™).

The compression housing, piston, piston rod, and distance housing can be made from materials including, but not limited to, ceramic, iron, cast iron, nodular cast iron, ductile iron, gray iron, aluminum, steel, cast steel, forged steel, stainless steel (e.g., 304, 316, 316L, 316H, 410, and 419), carbon steel, bronze, and alloys, including, but not limited to, nickel-based alloys (e.g., INCONEL® alloys), including, but not limited to, alloy 625, or any combination thereof. Just as with the resonating piston head, the compression piston head, piston rings, guide rings, and/or compression housing cylinder liner may be coated with an anti-friction compound, such as a thermoplastic polymer. Furthermore, the compression piston can be hollow, and use gas bearings of any variation. The distance and compression housing may also have multiple sealable access holes and a means of piston displacement control and return, which can include, but is not limited to, one or more springs (gas, mechanical, or any combination thereof) in multiple housings. Additionally, all of these components and others, such as replaceable cylinder liners, inlet/discharge valves, which can be corrosion resistant (e.g., stainless steel, engineered plastics) and of reed, one-way check, channel, concentric ring, ported plate, or poppet valve design, are all commercially available. Finally, all mating surfaces for thermoacoustic, distance, and compression housings not only provide first, second (via packing/strips), or no support to the piston rod, but can also provide means for guiding the reciprocating rod linearly and inhibiting radial movement.

Figure 3:
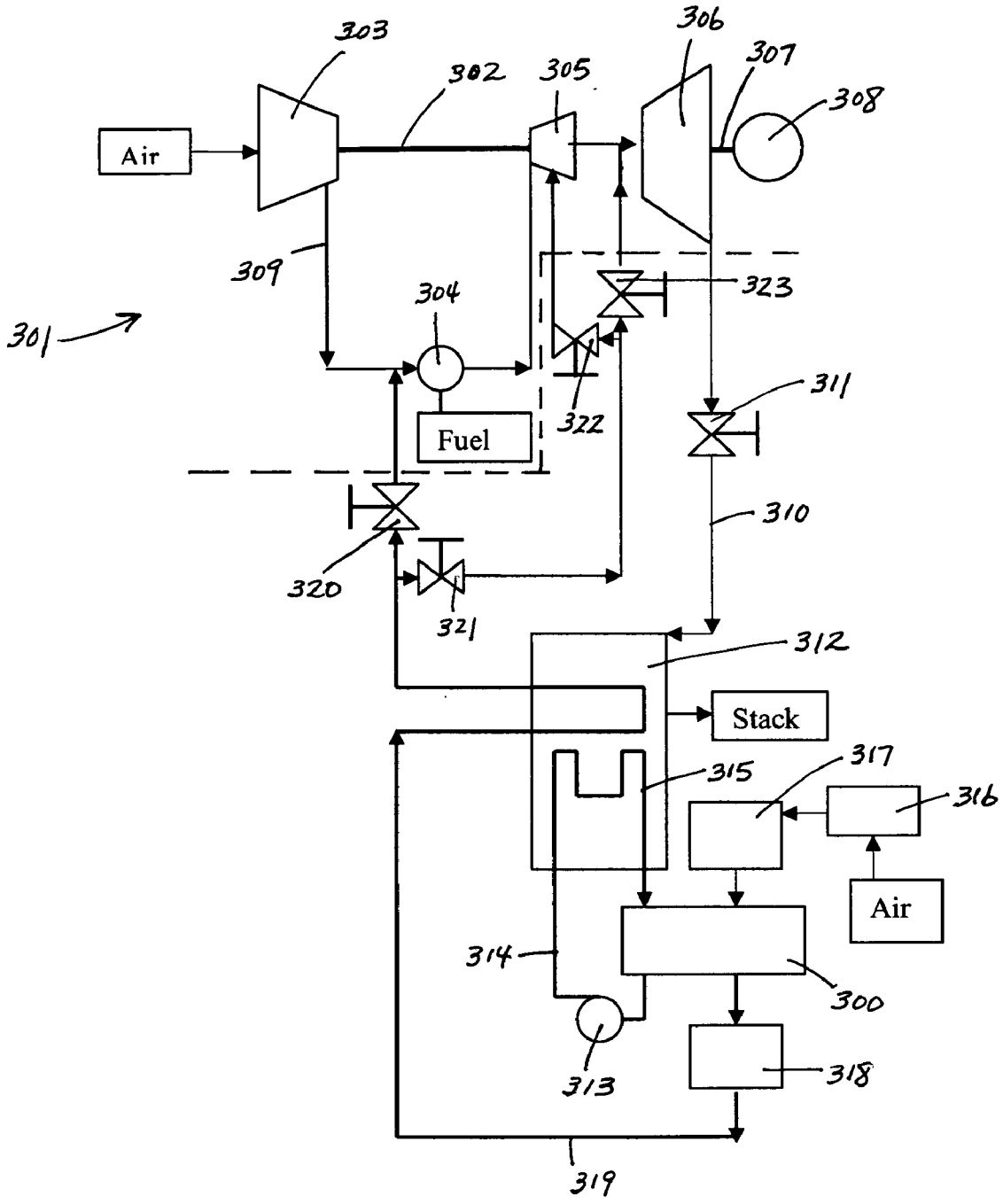
FIG. 3. A schematic of one embodiment of a thermoacoustic driven compressor/gas turbine system.

FIG. 3 schematically illustrates one embodiment of a TADC 300 interfaced with a gas turbine 301. In this embodiment, the gas turbine 301 has two shafts (mechanical drive). The first shaft assembly 302 of the gas turbine 301 includes a compressor 303 (intercooler not shown), a combustor 304, and a high pressure ("HP") turbine 305 (first part of two part expander). A power turbine 306 (second expander) is attached to the second shaft 307. This turbine 306 drives a mechanical device 308, which in this embodiment is a centrifugal compressor, such as for a gas pipeline. Other mechanical devices (on or offshore) include, but are not limited to, an electric generator or a pump (not shown).

To initiate the process, air is compressed in the compressor 303. The compressed air is then piped via flow path 309 to the combustor 304, where the air is mixed with fuel and ignited. The expanding gas drives both the HP turbine 305 and the power turbine 306. Exhaust heat exiting the gas turbine can be channeled via flow path 310 and optional valve 311 into a heat recovery unit ("HRU") 312. Concurrently, circulating fluid (via optional pump 313) can be pumped via flow path 314 into the HRU. The circulating fluid is heated via the exhaust and then piped via flow path 315 into the hot exchanger of the TADC 300. While not shown, cold fluid can also delivered (pump optional) into the cold exchanger of the TADC 300, and an additional exchanger and fan may also be included for cooling the cold fluid with ambient air.

The temperature gradient between the hot and cold exchangers of the TADC 300 powers the TADC 300. As a result, air is sucked through filter 316 and refrigeration unit 317 (optional) and compressed in TADC 300. The "free compressed air" is then channeled to a pulsation bottle 318, where the air flow is evened out. The compressed air can then be piped via flow path 319 to the HRU 312, where the air is further heated. At this point, the air can be directed via valves 320, 321, 322 and 323 to any stage, in any quantity, at any pressure, and at multiple locations in the gas turbine 301, specifically a point before the combustor 304 but after the turbine compressor 303, for example, prior to the NOx equipment (valve 320), the combustor 304, the HP turbine 305 (valves 321 and 322), and between the HP turbine exhaust outlet and power turbine inlet (valves 321 and 323). While not shown, other points include the turbine compressor 303, after the combustor 304 but before the HP turbine 305, the power turbine 306, a recuperator (if used) or some combination thereof. If a single shaft is used (not shown), air can also be directed to some point after the combustor, but before the turbine, and the turbine. The "free compressed air" improves the efficiency of the gas turbine 301 over various loads, as the work used to create the "free compressed air" was not obtained from the compressor 303 of the gas turbine 301. Said another way, the TADC 300 reduces the amount of $CO_2$ emitted per a given unit of energy produced from a gas turbine, allowing companies the potential to earn carbon credits in a carbon regulated environment. In addition, the TADC 300 allows for the use of heat that otherwise would be vented and lost from the gas turbine 301. The use of the TADC 300 thus means that the efficiency of the compressor 303 may be increased, thereby reducing the amount of natural gas needed for the compressor 303 in a gas pipeline. This results in lower costs for the operator of a gas pipeline using a TADC 300 with the compressor 303.

Figure 4A:
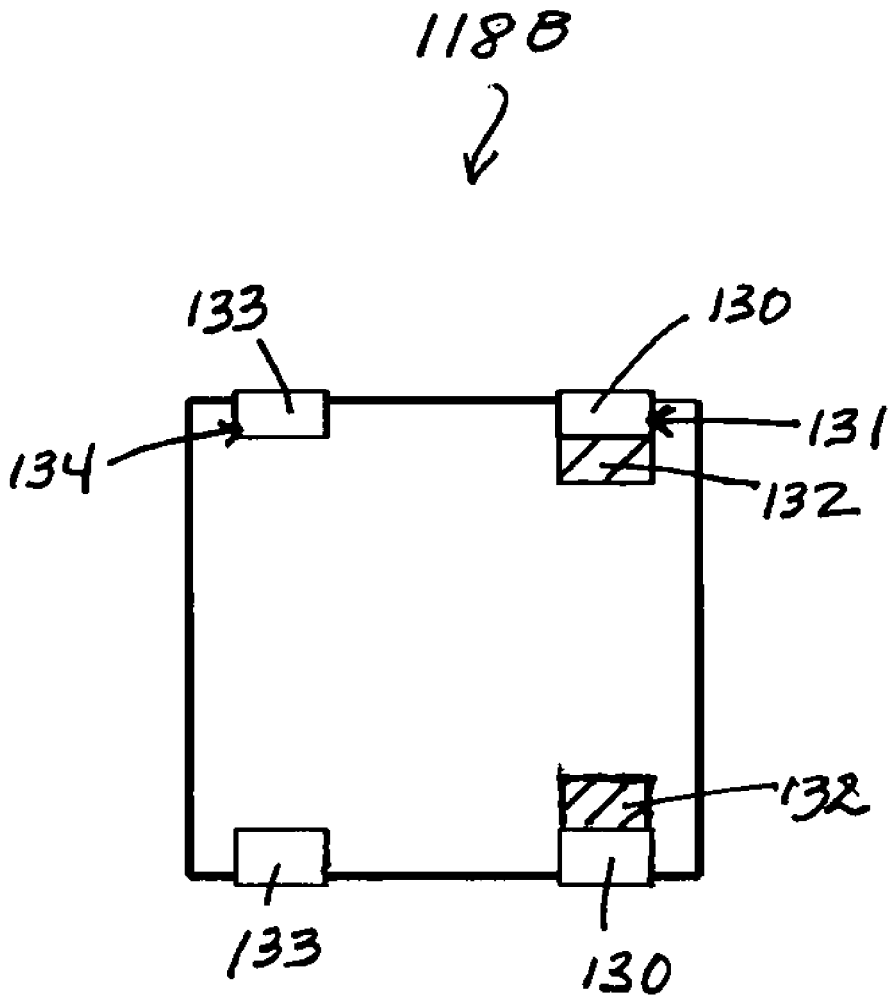
FIG. 4A, FIG. 4B, and FIG. 4C.

FIG. 4A provides detail for a variation of a single-acting non-lubricated compression piston head 118B for TADC 101 shown in FIG. 1. This compression piston head 118B contains a sealing ring 130 seated in a groove 131 in compression piston head 118B and coaxial with the axis of the piston and cavity side wall, thereby preventing compressed gas/fluid from leaking from the compression chamber 119 between the compression piston head 118B and the inner surface of the compression housing 117. A biasing means 132 of forcing the sealing ring 130 to stay in contact with the inner surface of the compression housing 117 can also be included, if such a device is not incorporated in sealing ring 130. To prevent the piston from coming into contact with the inner surface of the compression housing 117, at least one seated guide ring 133 (e.g., a rider ring) can be utilized, which is seated in a second groove 134 in the compression piston head 118B. As with the sealing ring 130, the guide ring 133 is coaxial with the axis of the compression piston head 118B and the inner surface of the compression housing 117.

Figure 4B:
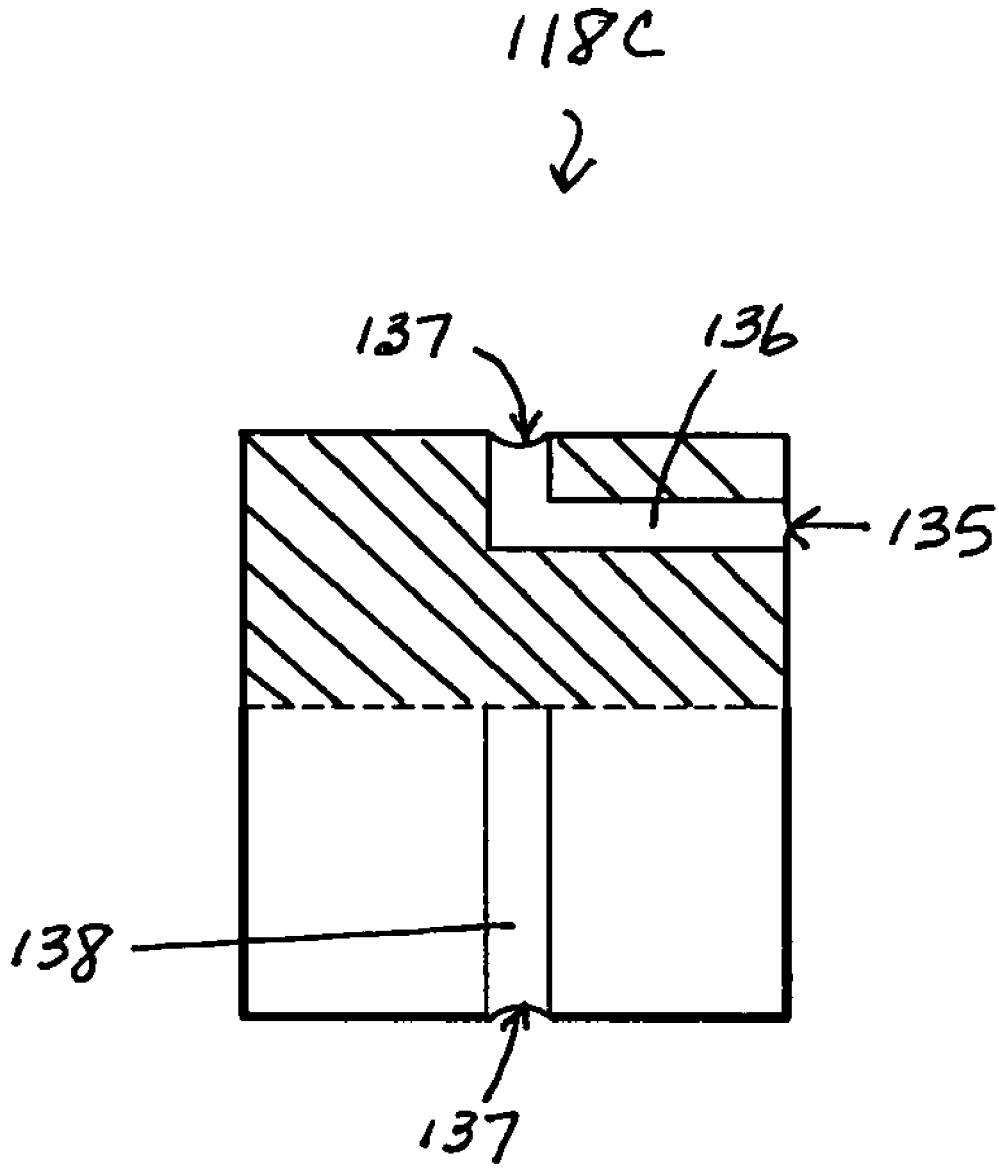

FIG. 4B demonstrates one embodiment of a single-acting non-lubricated compression piston head 118C utilizing a hydrostatic gas/fluid bearing with TADC 101 shown in FIG. 1. The basic operating characteristics are the same as those mentioned earlier. However, as compression piston head 118C moves forward (to the right in FIG. 1), some of the pressurized process gas/fluid (e.g., air) in the compression chamber 119 is delivered to a clearance gap between the outer wall of compression piston head 118C and the inner wall of compression housing 117, thereby providing a gas bearing. The delivery system can include, but is not limited to, at least a first aperture 135, a passageway 136, a second aperture 137, a circumferential groove 138, which is set about the outer wall of compression piston head 118C, or some combination thereof. While not shown, another example could have multiple branches originating from passageway 136 to additional apertures in fluid communication with circumferential groove 138. In yet another embodiment, the compression piston incorporates a one-way valve with the first aperture 135, a reservoir, and multiple apertures in the compression piston head at angularly spaced locations around the circumference of the sliding compression piston, all of which are in fluid communication with the reservoir; however, in this case no circumferential groove is required (see, e.g., U.S. Pat. No. 5,525,845). The gas bearing in FIG. 4B can also be used with a double-acting piston (not shown) as described above (or in any other single/double-acting iteration described below; not shown); however, at least a second set of apertures (not shown), another passageway (not shown), and a second circumferential groove (not shown) delivering gas/fluid (not shown) from the opposite compression chamber (not shown) would be required (see, e.g., U.S. Pat. No. 4,932,313). Conversely, pressurized gas/fluid from the compression housing 117 can be delivered to the clearance gap via a system that is part of the compression housing (discussed in greater detail in FIG. 4C). In this example, at least one radial aperture (entrance; not shown) and at least three radial apertures (exit; not shown) would be required. Furthermore, the three radial apertures (not shown) would be formed in the compression housing 117 at angularly spaced locations around the circumference of the sliding compression piston head 118C (multiple sets are also possible). Connecting the entrance and exit apertures (not shown) is at least one passageway (not shown), which can be within, on top of, or in-between separate compression housings. This alternative could also use at least one one-way valve (not shown), a reservoir (not shown), and compressed gas/fluid (not shown) from an external source (not shown), such as a tank, a gas turbine bleed line, an on-site electrical compressor, a turbine-driven centrifugal compressor, a reciprocating compressor, a rotary compressor, a screw compressor, or other type of compression equipment/plant processes.

Figure 4C:
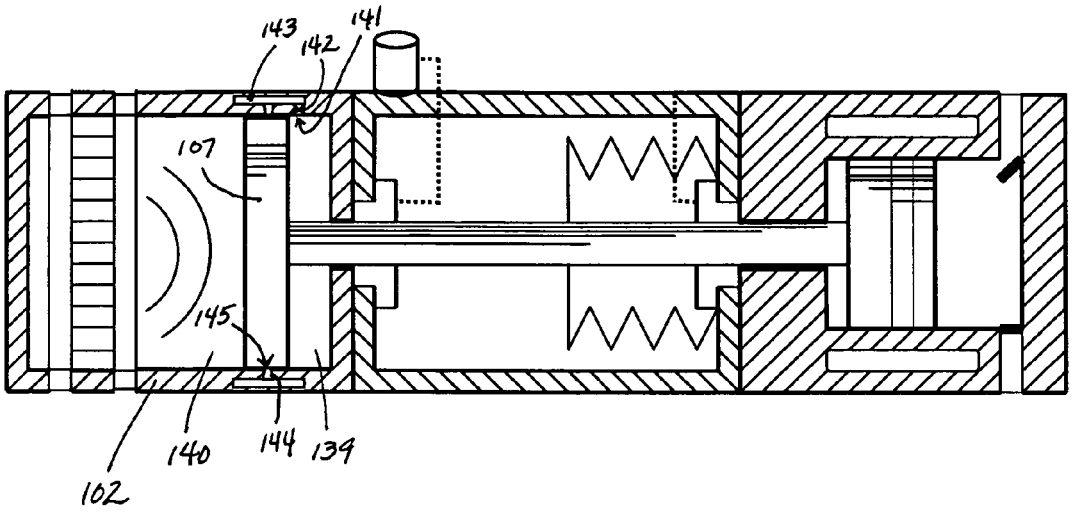

FIG. 4C provides detail to one embodiment of a resonating piston head for TADC 101 shown in FIG. 1 further including hydrostatic gas/fluid bearings. As shown in FIG. 4C, the pressurized working gas/fluid is drawn from the variable-volume chamber 139 to the right of the resonating piston head 107; however, the pressurized fluid could also be drawn from the opposing variable-volume chamber 140, or both. As the resonating piston head 107 moves to the right, the working gas/fluid in the variable-volume chamber 139 increases in pressure; this increase in pressure forces some of the gas/fluid through the aperture 141 and one-way valve 142 into reservoir 143. Seeking areas of lower pressure, the pressurized fluid in the reservoir 143 is dispersed via passageway(s) 144 and at least three radial apertures (exit) 145 in the thermoacoustic housing 102. The radial apertures 145 can be formed at angularly spaced locations around the circumference of the sliding resonating piston head 107. Furthermore, multiple sets of radial apertures 145 in fluid communication with passageway(s) 144 are also possible. As the pressurized fluid is released from the radial apertures 145, it is directed to a clearance gap in-between outer wall of resonating piston head 107 and inner wall of thermoacoustic housing 102, thereby providing a gas bearing. In this example the reservoir 143 and passageway(s) 144 are located within the thermoacoustic housing cylinder wall; however, other iterations can have these components within, on top of, or in-between separate compression housings (see, e.g., U.S. Pat. No. 6,293,184). In another embodiment, the one-way valve 142 and/or reservoir 143 may not be required. Furthermore, the pressurized fluid can be delivered to the clearance gap from both variable-volume chambers sequentially. A hydrostatic gas bearing may include, but is not limited to, any component discussed above, use a separate dedicated pump, and an aperture further consisting of orifices and/or porous media (e.g., carbon, bronze or steel), or some combination thereof. Finally, any gas bearing design as described in FIG. 4B and FIG. 4C can be used with any resonator piston head, even if resonator is attached to a lubricated compression piston head.

Figure 5:
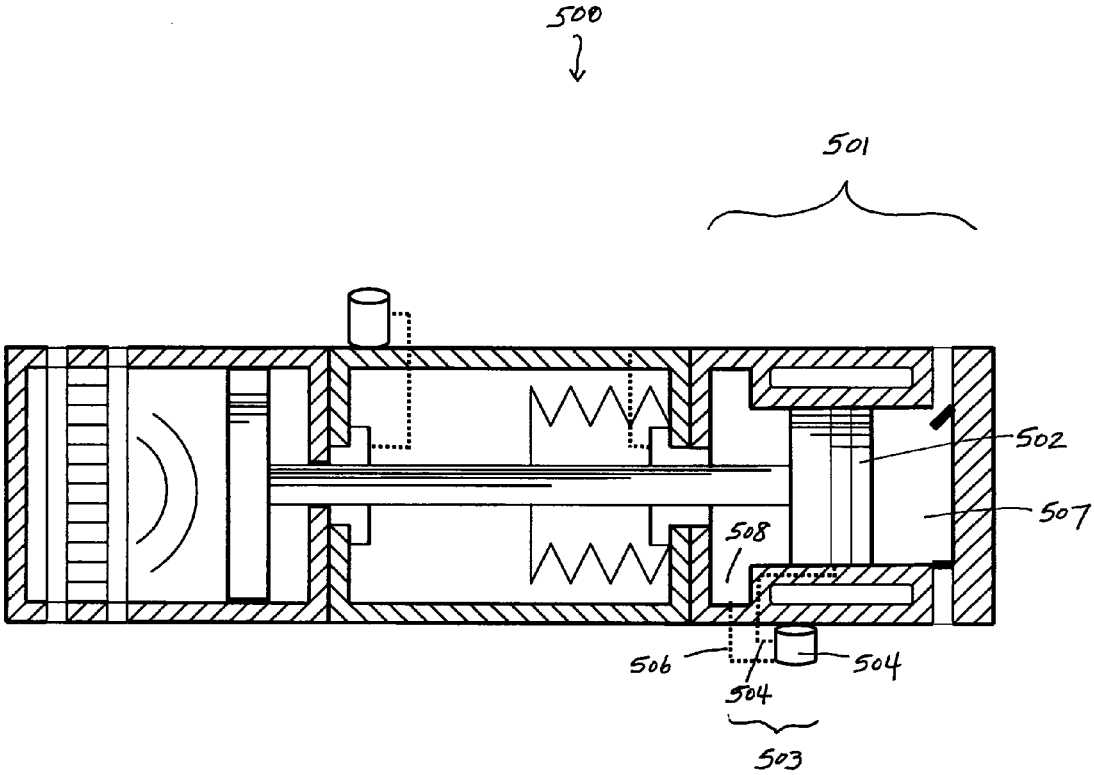
FIG. 5. A horizontal cross section through one embodiment of a single-acting lubricated thermoacoustic compressor.

FIG. 5 shows an embodiment of a single-acting lubricated standing wave TADC 500. This TADC is similar to the TADC shown in FIG. 1, except that the compression housing 501 differs from that shown in FIG. 1. Compression housing 501 contains compression piston head 502, which is lubricated by a pressurized lubricating system 503. In this embodiment, pressurized lubricating system 503 comprises pump 504, lubricant line 505, and lubricant recovery line 506. In addition to a compression chamber 507, compression housing 501 defines a cavity 508 for collecting lubricant, where it feeds into lubricant recovery line 506. While not shown, a pressurized lubricating system can also include items such as a lubricant filter, a lubricant dispenser, and a spray nozzle. Finally, lubricant wiper packing may be substituted for pressure packing.

Figure 6:
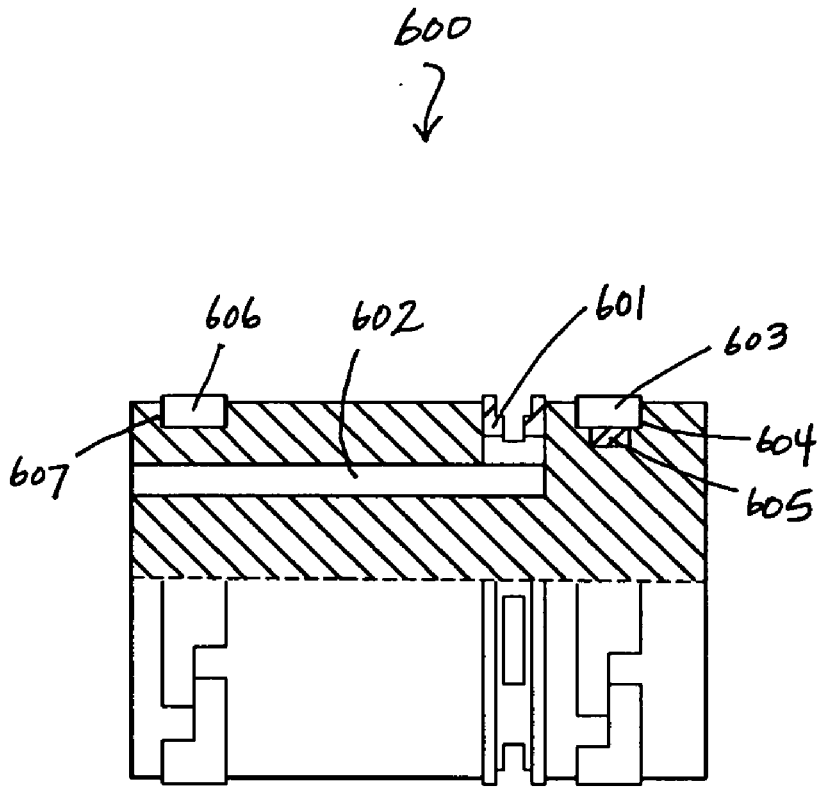
FIG. 6. A horizontal cross section through one embodiment of a single-acting lubricated compression piston head.

FIG. 6 shows a variation of a single-acting lubricated compression piston head 600 for use with the lubricated TADC 500 shown in FIG. 5. To remove lubricant from the cavity wall, the compression piston head 600 utilizes a scraper ring 601. The scraper ring can be made from metal (e.g., cast iron or aluminum) or metal alloy. Scraper ring 601 channels lubricant into a port 602, which directs the lubricant to the portion of the compression housing (501 in FIG. 5) comprising a cavity (508 in FIG. 5) for collecting the lubricant. As with the non-lubricated piston head, the lubricated compression piston head 600 also comprises a sealing ring 603 seated in a groove 604 in compression piston head 600 and coaxial with the axis of the compression piston head 600 and the inner surface of the compression housing (501 in FIG. 5), thereby preventing compressed gas/fluid from leaking from the compression chamber (507 in FIG. 5) between the compression piston head 600 and the inner surface of the compression housing (501 in FIG. 5). A biasing means 605 for forcing the sealing ring 603 to stay in contact with the inner surface of the compression housing (501 in FIG. 5) can also be included, if such a device is not incorporated in sealing ring 603. To prevent the compression piston head 600 from coming into contact with the inner surface of the compression housing (501 in FIG. 5), at least one seated guide ring 606 can be utilized, which is seated in a second groove 607 in the compression piston head 600. As with the sealing ring 603, the guide ring 606 is coaxial with the axis of the compression piston head 600 and the inner surface of the compression housing (501 in FIG. 5).

The TADC 500 shown in FIG. 5 utilizes lubricant in a closed loop system, and as a result, very little lubricant seeps into the compressed fluid or gas stream. However, a single or double-acting TADC 500 of any variation can utilize "once through" lubrication, wherein new lubricant is continuously force-fed into the compression chamber. In such embodiments, a scraper ring and cavity are not required. In "once through" lubrication, the lubricant lubricates the compression piston head and exits through the exhaust port with the compressed process gas/fluid. Upon exit, a means, such as a coalescer, can be used to separate the lubricant from the compressed processed gas/fluid.

As mentioned above, for control of piston displacement and return, a spring (gas (like spring 232 in FIG. 2), mechanical (like spring 111 in FIG. 1), or combination thereof) can be used in any or multiple housings. However, if a spring(s) is deemed not sufficient, as described below an additional thermoacoustic engine (housing and engine core), as described herein, can be attached to the top of the single- or double-acting TADC compression housing (see, e.g., FIG. 7). Also, a distance housing (like housing 728 in FIG. 7), as described herein, can separate the compression housing from the second thermoacoustic engine. Inside the additional housing(s), a tandem rod and resonating piston combination is mated to the top of the single-acting or double-acting compression piston (see, e.g., FIG. 7). In essence, a second thermoacoustic engine is utilized, can be in conjunction with a spring(s) (gas, mechanical, or combination thereof) in any or multiple housings, to force the piston back. A porting means can also be included (not shown).

Figure 7A:
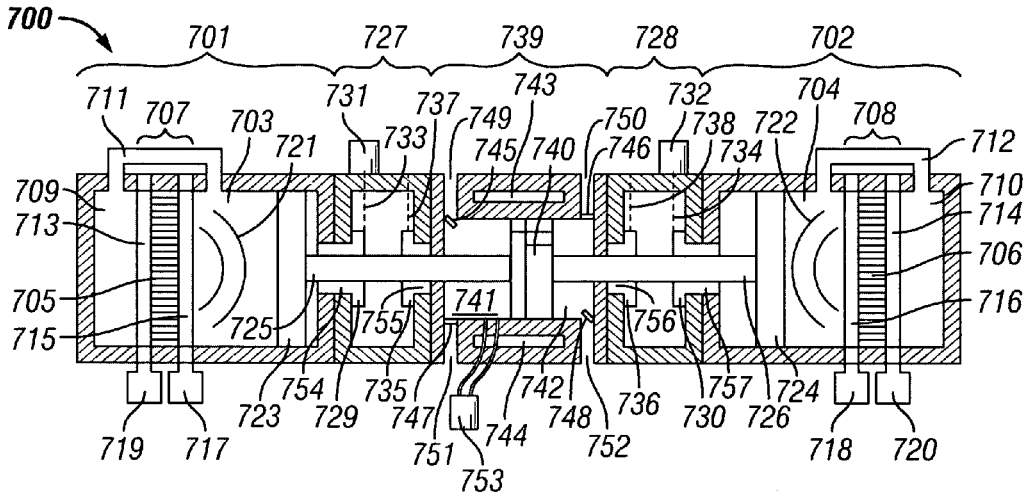
FIG. 7A and FIG. 7B.

FIG. 7A shows one embodiment of a double-acting non-lubricating traveling wave TADC 700 with two thermoacoustic housings 701 and 702, each of which comprise a pressurized compressible working gas/fluid 703 and 704. Thermoacoustic housings 701 and 702 each incorporate a regenerator 705 and 706 in the thermoacoustic engine core 707 and 708. While not shown, one or more TBTs can also be incorporated adjacent to the hot exchanger, thereby mitigating heat leaks (and corresponding efficiency loss) from the hot exchanger to ambient. Additionally, the thermoacoustic housings 701 and 702 are of a torus configuration that incorporate a compliance portion 709 and 710 and an inertance tube 711 and 712. In the depicted traveling wave embodiment, the cold exchangers 713 and 714 are upstream of the hot exchangers 715 and 716. When the hot exchangers 715 and 716 and cold exchangers 713 and 714 are connected to hot sources 717 and 718 and cold sources 719 and 720, respectively, a temperature differential is created between the two exchangers. This temperature differential enables the regenerators 705 and 706 to amplify incoming acoustic power (not visibly shown, but represented by 721 and 722) and pump acoustic power out of the hot exchangers 715 and 716. This acoustic power is used to drive the linearly resonating piston heads 723 and 724, which are connected to piston rods 725 and 726, and provide new acoustic power to the cold exchangers 713 and 714 via the inertance tubes 711 and 712 and compliance portions 709 and 710.

The distance housings 727 and 728 contain a continuation of the linearly reciprocating piston rods 725 and 726. Additionally, pressure packings 729 and 730, each with an accompanying purging canister 731 and 732 and a purging line 733 and 734, can be set about the piston rods 725 and 726 and the piston rod apertures 754, 755, 756, and 757, in the distance housings 727 and 728, and pressure packings 735 and 736, each with an accompanying vent tube 737 and 738, can be set about the piston rods 725 and 726 and the piston rod apertures in the distance housings 727 and 728.

Compression housing 739 incorporates a double-acting compression piston head 740. The compression housing 739 and double-acting compression piston head 740 define two compression chambers 741 and 742. Compression housing 739 also comprises the remaining portion of piston rods 725 and 726, sealing and/or guide rings (discussed below), water jackets 743 and 744, gas/fluid inlet valves 745 and 746, gas/fluid discharge valves 747 and 748, gas/fluid inlet ports 749 and 750, and gas/fluid discharge ports 751 and 752.

To start TADC 700, a starting mechanism 753 can be used to propel compression piston head 740 forward (to the right in FIG. 7A). As a result, the process gas/fluid in compression chamber 742 is compressed. When the pressure in the compression chamber exceeds the discharge pressure, the process gas/fluid is released via the discharge valve 748. This also opens inlet valve 745 so that process gas/fluid can enter compression chamber 741. On the return stroke, powered by the temperature differential created in thermoacoustic engine core 708, traveling acoustic wave 722 propels linear resonating piston head 724 (to the left in FIG. 7A). As the compression piston head 740 is connected to piston rod 726, the force applied to the resonating piston head 724 propels the compression piston head 740 forward (to the left in FIG. 7A). As a result, the process gas/fluid in compression chamber 741 is compressed. When the pressure in the compression chamber exceeds the discharge pressure, the process gas/fluid is released via the discharge valve 747. This also opens inlet valve 746 so that new gas/fluid can enter compression chamber 742. It is also to be understood that if piston head 740 has difficulty initially moving forward (to the right in FIG. 7A), discharge valve 748 can be configured to open sooner, thereby reducing the load on compression piston head 740. Similarly, on the return stroke, discharge valve 747 can also be configured to open sooner.

The starting mechanism 753 for TADC 700 (and 800 and 900 discussed below) can take a variety of different forms. For example, compressed air could be injected into one or both (in alternating sequence) sides of the compression piston head 740 via a separate delivery system or the valved inlet ports 749 and 750. Compressed air could also be applied to an expansion unit (not shown) in one or both of the distance pieces 727 and 728. The sources for the compressed air could include an air tank, a gas turbine bleed line, an on-site electrical compressor, a turbine-driven centrifugal compressor, a reciprocating compressor, a rotary compressor, a screw compressor, or other type of compression equipment/plant processes (not shown). Additionally, compressed working fluid could be injected into one or both thermoacoustic housings 701 and 702 between the resonating piston head 723 and 724 and housing 701 and 702 (via a purging canister, not shown). Another means of starting oscillation would be to insert a magnet (not shown) in the compression piston head 740 and a coil at both ends of the compression housing 739, and alternate electric voltage between both ends.

Figure 7B:
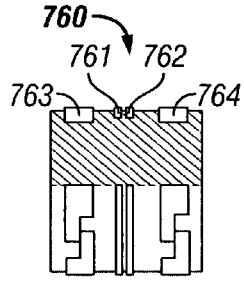

FIG. 7B shows one variation of a double-acting non-lubricated/lubricated compression piston head 760, which could be used with TADC 700 or any other double-acting TADC. In this embodiment, two seated sealing rings 761 and 762 are located at the center of compression piston head 760, while at least two guiding rings 763 and 764 are located on opposite sides of the sealing rings 761 and 762. A means (not shown) of forcing the sealing rings 761 and 762 to stay in contact with the inner surface of the compression housing 739 can also be included, if such a device is not incorporated in the sealing rings 761 and 762. Another option includes incorporating at least one sealing ring at both ends (not shown) of the compression piston head 740, and a means of forcing the sealing rings to stay in contact with the inner surface of the compression housing 739.

Figure 8:
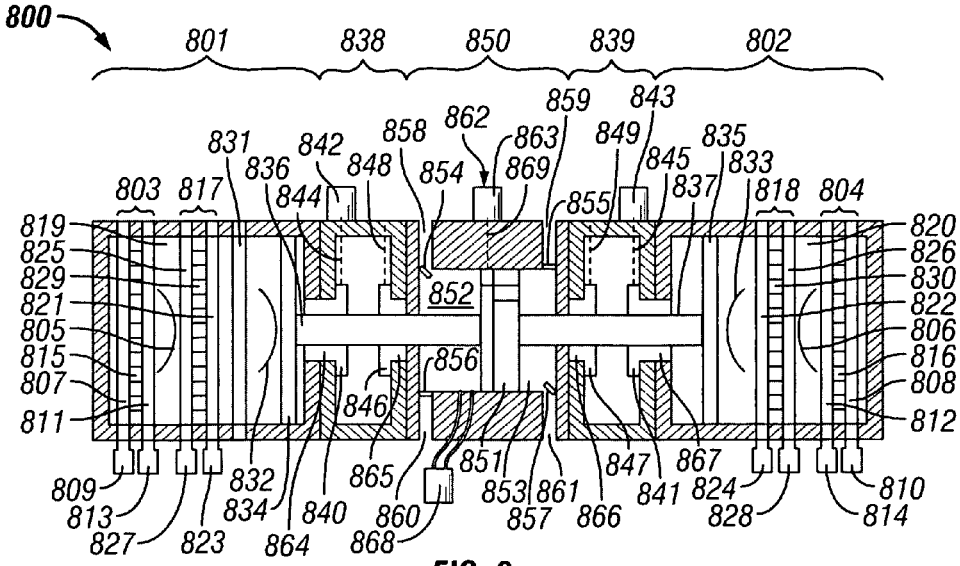
FIG. 8. A horizontal cross section through one embodiment of a double-acting lubricated thermoacoustic driven compressor incorporating a cascaded thermoacoustic engine and a tandem resonator at both ends of the compression piston head.

FIG. 8 provides one embodiment of a double-acting lubricated cascaded TADC 800. In this embodiment, thermoacoustic housings 801 and 802 can each be approximately 1 acoustic wavelength long (the same length as the wavelength of the acoustic wave) and contain pressurized compressible working fluid. Furthermore, both thermoacoustic housings 801 and 802 comprise at least one stack-based thermoacoustic engine core (803 and 804, respectively), which is used to initiate an acoustic pressure wave (not visible, but represented by 805 and 806, respectively) and at least one regenerator-based thermoacoustic engine core (817 and 818, respectively). Each stack-based thermoacoustic engine core (803 and 804) comprises a hot exchanger (807 and 808, respectively) connected to a hot source (809 and 810, respectively) and a cold exchanger (811 and 812, respectively) connected to a cold source (813 and 814, respectively). Stacks (815 and 816, respectively) are located between the hot exchangers (807 and 808, respectively) and the cold exchangers (811 and 812, respectively). Separating the stack-based engines 803 and 804 from the regenerator-based thermoacoustic engines (817 and 818, respectively) can be TBTs (819 and 820, respectively), which mitigate heat leakage between the stack-based and regenerator-based thermoacoustic engines. Each regenerator-based thermoacoustic engine core (817 and 818) comprises a hot exchanger (821 and 822, respectively) connected to a hot source (823 and 824, respectively) and a cold exchanger (825 and 826, respectively) connected to a cold source (827 and 828, respectively). Regenerators (829 and 830, respectively) are located between the hot exchangers (821 and 822, respectively) and the cold exchangers (825 and 826, respectively). Also shown in thermoacoustic housing 801 is an optional ambient exchanger 831 (can be used in both housings). Regenerators 829 and 830 amplify the acoustic power (not visible, but represented by 832 and 833, respectively) created by stack-based engines 803 and 804. This acoustic power is used to drive the linearly resonating piston heads 834 and 835, which are connected to piston rods 836 and 837.

The distance housings 838 and 839 contain a continuation of the linearly reciprocating piston rods 836 and 837. Additionally, pressure packings 840 and 841, each with an accompanying purging canister 842 and 843 and a purging line 844 and 845, can be set about the piston rods 836 and 837 and the piston rod apertures 864, 865, 866, and 867, of the distance housings 838 and 839, and pressure/lubricating packings 846 and 847, each with an accompanying vent tube 848 and 849, can be set about the piston rods 836 and 837 and the piston rod apertures of the distance housings 838 and 839.

Compression housing 850 incorporates a double-acting compression piston head 851. The compression housing 850 and double-acting compression piston head 851 define two compression chambers 852 and 853. Compression housing 850 also comprises the remaining portion of piston rods 836 and 837, sealing and guide rings (discussed above), gas/fluid inlet valves 854 and 855 and gas/fluid discharge valves 856 and 857, and gas/fluid inlet ports 858 and 859 and gas/fluid discharge ports 860 and 861. Compression housing 850 also comprises lubricating system 862 comprising pump 863 and lubricant line 869 (lubricant dispenser and filter not shown).

To start TADC 800, a starting mechanism 868 can be used to propel compression piston head 851 forward (to the right in FIG. 8). As a result, the gas/fluid in compression chamber 853 is compressed. When the pressure in the compression chamber exceeds the discharge pressure, the process gas/fluid is released via the discharge valve 857. This also opens inlet valve 854 so that process gas/fluid can enter compression chamber 852. On the return stroke, the amplified traveling acoustic wave 833 propels linear resonating piston head 835 (to the left in FIG. 8). As the compression piston head 851 is connected to piston rod 837, the force applied to the resonating piston head 835 propels the compression piston head 851 forward (to the left in FIG. 8). As a result, the process gas/fluid in compression chamber 852 is compressed. When the pressure in the compression chamber exceeds the discharge pressure, the process gas/fluid is released via the discharge valve 856. This also opens inlet valve 855 so that new process gas/fluid can enter compression chamber 853. It is also to be understood that if piston head 851 has difficulty initially moving forward (to the right in FIG. 8), discharge valve 857 can be configured to open sooner, thereby reducing the load on compression piston head 851. Similarly, on the return stroke, discharge valve 856 can also be configured to open sooner.

Figure 9:
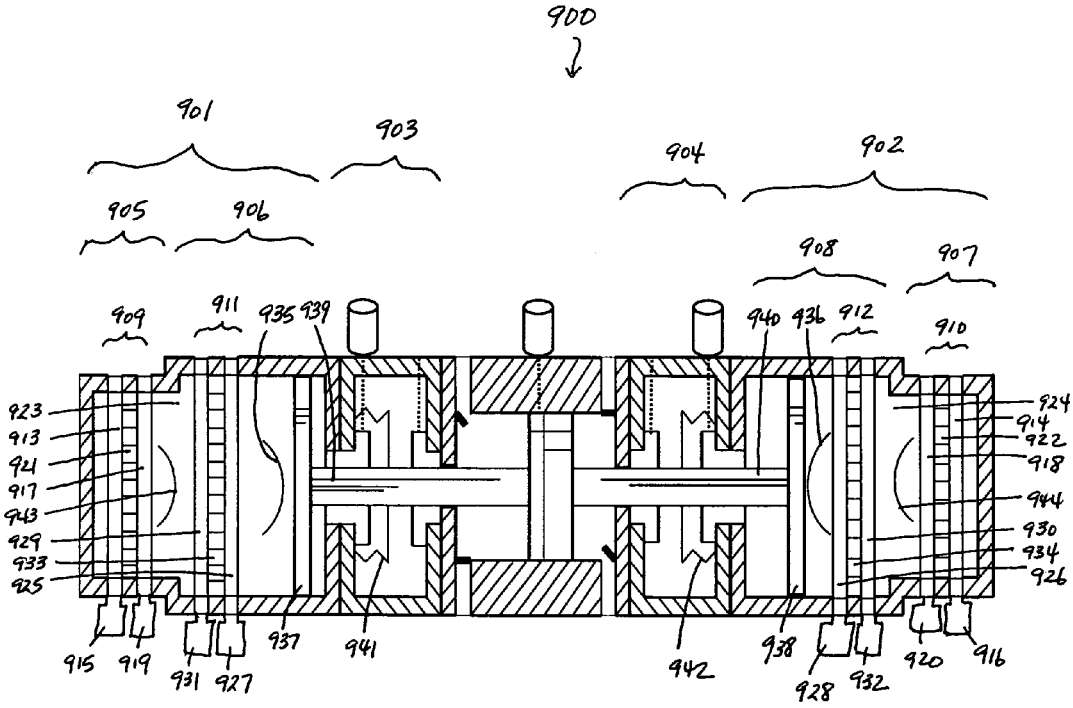
FIG. 9. A horizontal cross section through a second embodiment of a double-acting lubricated thermoacoustic driven compressor incorporating a cascaded thermoacoustic engine and a tandem resonator at both ends of the compression piston head.

FIG. 9 demonstrates another embodiment of a double-acting lubricated cascaded TADC 900. TADC 900 is similar to TADC 800 shown in FIG. 8, except that the thermoacoustic housings 901 and 902 and distance housings 903 and 904 differ from those shown in FIG. 8 (thermoacoustic housings 801 and 802, and distance housings 838 and 839). Thermoacoustic housings 901 and 902 each comprise two different cross-sectional areas (905 and 906, and 907 and 908, respectively) with each cross sectional area having a length of approximately ¼ acoustic wavelength. The portion of the thermoacoustic housings with the smaller cross-sectional area (905 and 907, respectively) can comprise a stack-based thermoacoustic engine core (909 and 910, respectively), and the portion of the thermoacoustic housings with the larger cross-sectional area (906 and 908, respectively) can comprise a regenerator-based thermoacoustic engine core (911 and 912, respectively). As detailed in FIG. 8, above, the stack-based thermoacoustic engine cores 909 and 910 are used to initiate an acoustic pressure wave (not visible, but represented by 943 and 944, respectively). Each stack-based thermoacoustic engine core (909 and 910) comprises a hot exchanger (913 and 914, respectively) connected to a hot source (915 and 916, respectively) and a cold exchanger (917 and 918, respectively) connected to a cold source (919 and 920, respectively). Stacks (921 and 922, respectively) are located between the hot exchangers (913 and 914, respectively) and the cold exchangers (917 and 918, respectively). Separating the stack-based engine cores 909 and 910 from the regenerator-based thermoacoustic engine cores (911 and 912, respectively) can be TBTs (923 and 924, respectively), which mitigate heat leakage between the stack-based and regenerator-based thermoacoustic engine cores. Each regenerator-based thermoacoustic engine core (911 and 912) comprises a hot exchanger (925 and 926, respectively) connected to a hot source (927 and 928, respectively) and a cold exchanger (929 and 930, respectively) connected to a cold source (931 and 932, respectively). Regenerators (933 and 934, respectively) are located between the hot exchangers (925 and 926, respectively) and the cold exchangers (929 and 930, respectively). Regenerators 933 and 934 amplify the acoustic power (not visible, but represented by 935 and 936, respectively) created by stack-based engines 909 and 910. This acoustic power is used to drive the linearly resonating piston heads 937 and 938, which are connected to piston rods 939 and 940. Distance housings 903 and 904 differ from those shown in FIG. 8 (838 and 839) by the inclusion of a mechanical spring (941 and 942, respectively). This spring can also be gas, or combination thereof, and can also be present in multiple locations in the distance, thermoacoustic, and compression housings. A porting means, which can be valved, could also be incorporated.

Cascaded thermoacoustic engines (engines and housings) of any variation (see, e.g., U.S. Pat. No. 6,658,862) can be used to power both resonating piston heads 937 and 938. With the cascade design, a stack-derived thermoacoustic engine core can be used to initiate the acoustic pressure wave, and exchangers can be arranged in any order. A regenerator-derived engine core is used to amplify the acoustic power generated from the stack. In certain embodiments, the TBT can actually connect the stack-based thermoacoustic engine core and the regenerator-based thermoacoustic engine core. In general, the TBT is at least as long as the peak-to-peak displacement of the gas/fluid and can also be tapered (see, e.g., U.S. Pat. No. 5,953,920). For additional power, one or more stacks, regenerators, or TBTs in any combination can be added in series, and a bellows can be added to accommodate thermal expansion and contraction of the various components. Flow straighteners and additional ambient exchangers may also be added. If heat leaks are excessive, a second housing can encase the thermoacoustic housing. The thermoacoustic housing (resonating tube) can extend beyond the second housing, although this generally requires the use of seals. The second housing can be pressurized to a similar pressure as that of the thermoacoustic housing, and can also contain insulation.

The stacks and regenerators within the thermoacoustic housings should generally be placed in a region of the acoustic wave of high specific acoustic impedance. It is also possible to have multiple regions of high specific acoustic impedance along an axis in the thermoacoustic housing (e.g., a housing that is 1 acoustic wavelength long). In such a case, each region could contain adjacent multiple stacks, TBTs, and/or regenerators (which could be connected) in series and in any combination thereof. A means of creating multiple regions of high specific acoustic impedance would be to insert an approximately ½ acoustic wavelength resonator of different cross-sectional area between the approximately ¼ acoustic wavelength resonators as shown in FIG. 9 (indefinite ½ acoustic wavelength extensions, and other extension lengths, are possible). Additionally, between at least two regions of high specific acoustic impedance a side branch and bulb combination, which is generally orthogonal to the axis of the resonator, can also be added to the thermoacoustic housing, thereby providing axially extended regions with high specific acoustic impedance (see, e.g., U.S. Pat. No. 6,658,862). Finally, this extended region can be further extended by periodically adding additional side branch and bulb combinations. For additional balance, these side branches can be on both sides of the resonator at the same axial location.

Figure 10:
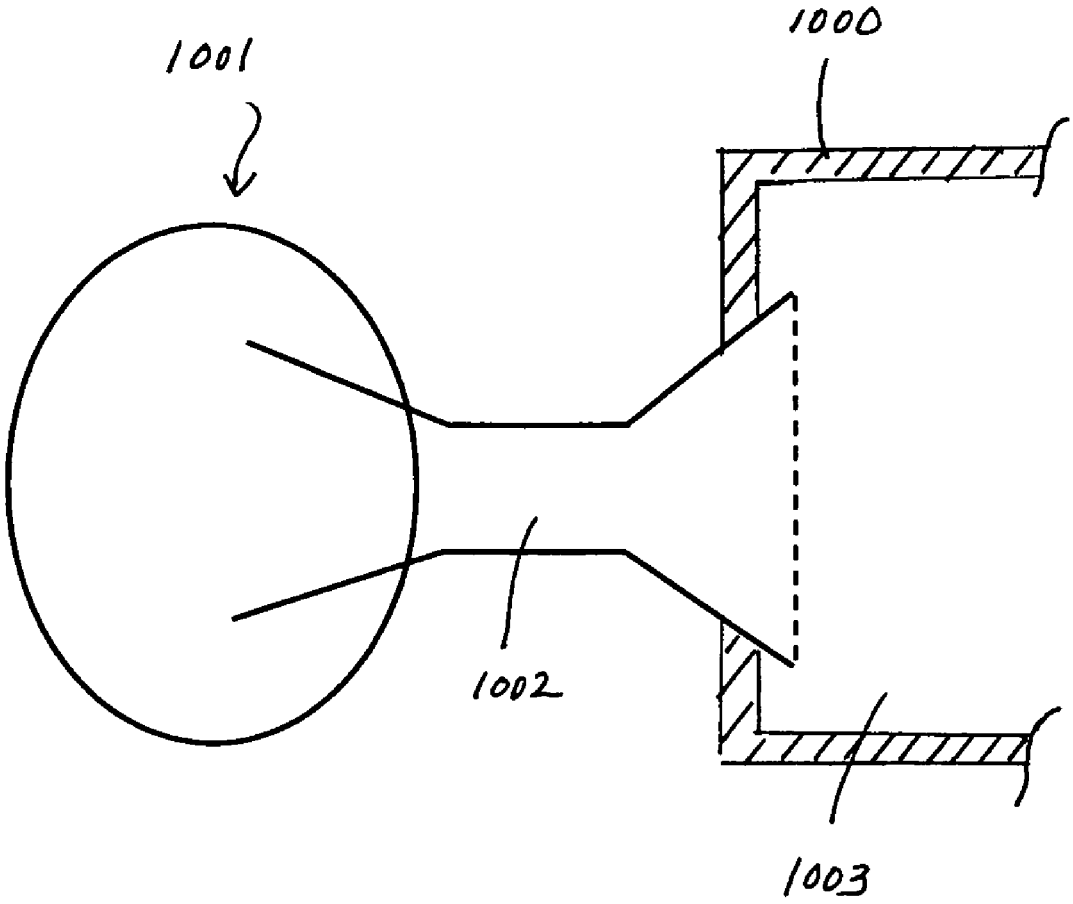
FIG. 10. Optional design of thermoacoustic end-housing with expanded compliance section.

FIG. 10 describes an optional design of a thermoacoustic end-housing 1000 with an expanded compliance section 1001 (see, e.g., U.S. Pat. No. 6,658,862), which can be used with an embodiment of a TADC 900 as shown in FIG. 9. The circumference of the piping 1002 may expand as it approaches and penetrates into the expanded compliance section 1001, thereby lowering the velocity of the gas coming from the compliance section 1003.

For multistage compression, multiple TADCs of any variation can be mated together in any orientation. Piping, with inter-cooling and optional coalescer/scrubber, connects the discharge ports to the inlet ports, allowing for the transmission of compressed air. If desired, a refrigerator (including thermoacoustic and Sterling refrigerators) or a desiccant dryer can also be incorporated to dehumidify the air after compression.

Figure 11:
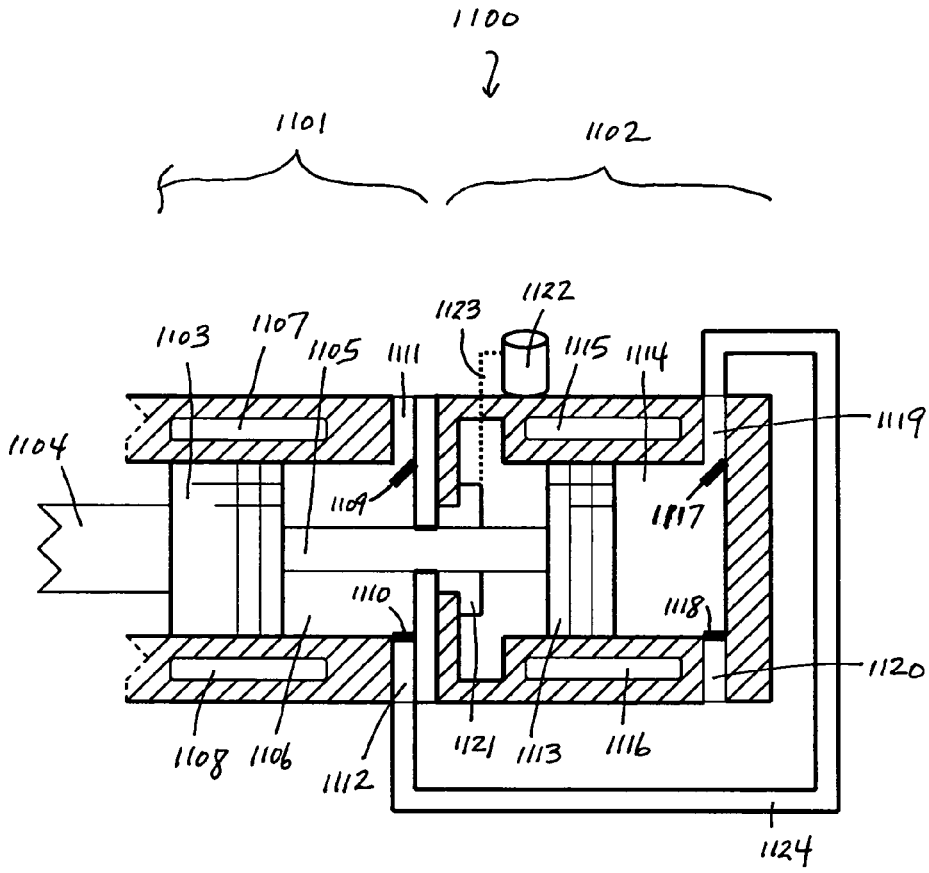
FIG. 11. A horizontal cross section through one embodiment of a multistage thermoacoustic driven compressor incorporating a tandem compression head.

As described in one embodiment in FIG. 11, another means of creating multistage compression (or additional capacity) comprises mating a second compression housing to the compression housing of a single or double-acting TADC with one thermoacoustic engine; a second distance piece, accompanying pressure packing, purging canister, purging line, and/or vent tube, as described herein, can also be included. Inside, a tandem single or double-acting compression piston head and piston rod would be mated to the master piston of the TADC. Such embodiments are not limited to one additional compression housing and distance piece, and depending on need (multistage or capacity), tandem compression piston can vary in size. Also, if the tandem compression piston is double-acting, the second compression chamber would have more than one vented inlet and outlet port.

FIG. 11 describes one embodiment of a tandem single-acting non-lubricated TADC 1100 with one thermoacoustic engine (not shown). This embodiment incorporates a first compression housing 1101 and a second compression housing 1102. First compression housing 1101 comprises a first compression piston head 1103, which is attached to a first piston rod 1104 and a second piston rod 1105. First compression housing 1101 and first compression piston head 1103 define a first compression chamber 1106. First compression housing 1101 also comprises piston and guide rings (not shown), water jackets 1107 and 1108 (optional), gas/fluid inlet valve 1109, gas/fluid discharge valve 1110, gas/fluid inlet port 1111, and gas/fluid discharge port 1112. Second compression housing 1102 comprises a second compression piston head 1113, which is attached to the top end of the first compression piston head 1103 via the second piston rod 1105. The second compression housing 1102 and second compression piston head 1113 define a second compression chamber 1114. Second compression housing 1102 also comprises piston and guide rings (not shown), water jackets 1115 and 1116, gas/fluid inlet valve 1117, gas/fluid discharge valve 1118, gas/fluid inlet port 1119, and gas/fluid discharge port 1120. Second compression housing 1102 also comprises pressure packing 1121, with an accompanying purging canister 1122 and a purging line 1123 set about the second piston rod 1105 and the mating surface of the first compression housing 1101; while not shown, a vent tube may be used in lieu of a purging canister and purging line. In this embodiment, as with the other types of multistage compression, the gas/fluid discharge port 1112 of the first compression housing 1101 can be connected via piping 1124 to the gas/fluid intake port 1119 of the second compressor housing 1102. In other embodiments, inter-cooling, lubrication, scrubbers, dehumidification, and coalescers (not shown) can also be utilized.

The TADC as discussed in FIG. 7A, as well as other embodiments (e.g., FIG. 8, and FIG. 9), could also be further expanded to generate multistage compression (or additional capacity). In this case (not shown), as described herein, at least one additional compression housing, compression piston (piston size and housing will vary depending on purpose), piston rod, pressure/lubrication wiper packing with either purging canister and line or venting tube, and distance housing (optional) could be inserted between the compression housing and the second thermoacoustic housing or distance housing. Inter-cooling, coalescers, dehumidification, and scrubbers (not shown) can also be utilized.

A means (not shown) of condensing process gas/fluid (e.g., air), such as refrigeration (which can be thermoacoustic or Sterling refrigeration), can also be attached to the inlet port of a single or multistage TADC of any variation, thereby allowing greater volumes of process gas/fluid to be compressed. Filter(s) (not shown) can also be added to the inlet port to clean the process gas/fluid. Pulsation tubes (not shown) can also be used to even out the flow of processed gas/fluid from the TADC; the pulsation tubes can be directly attached to TADC. The compressed gas/fluid can also be stored (not shown) before use and a Heat Recovery Unit (HRU)/exchanger or similar device (not shown) can be used to heat the compressed gas/fluid before use. Finally, valves (not shown) can be used in any location for controlling flow of process gas/fluids.

Figure 12A:
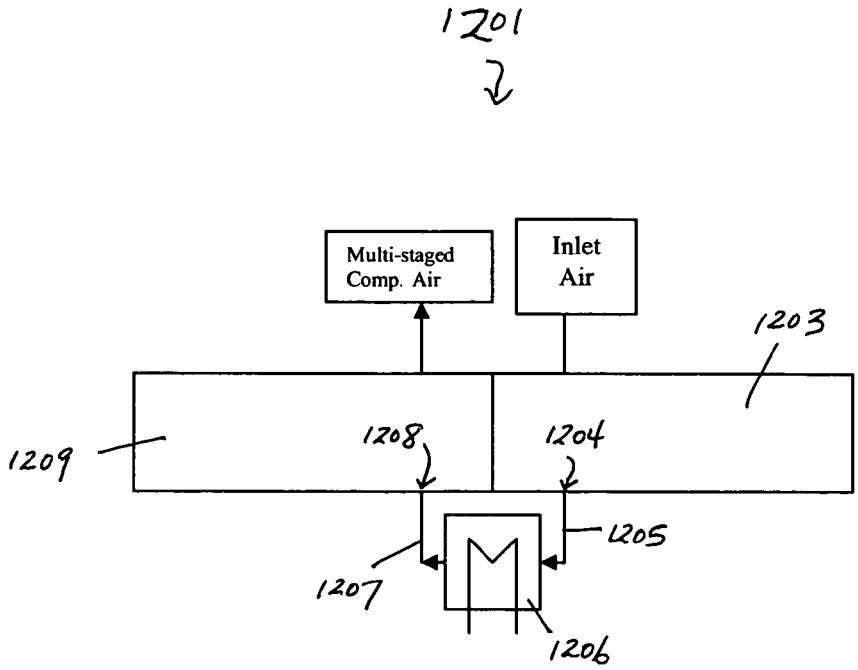
FIG. 12A and FIG. 12B.
Figure 12B:
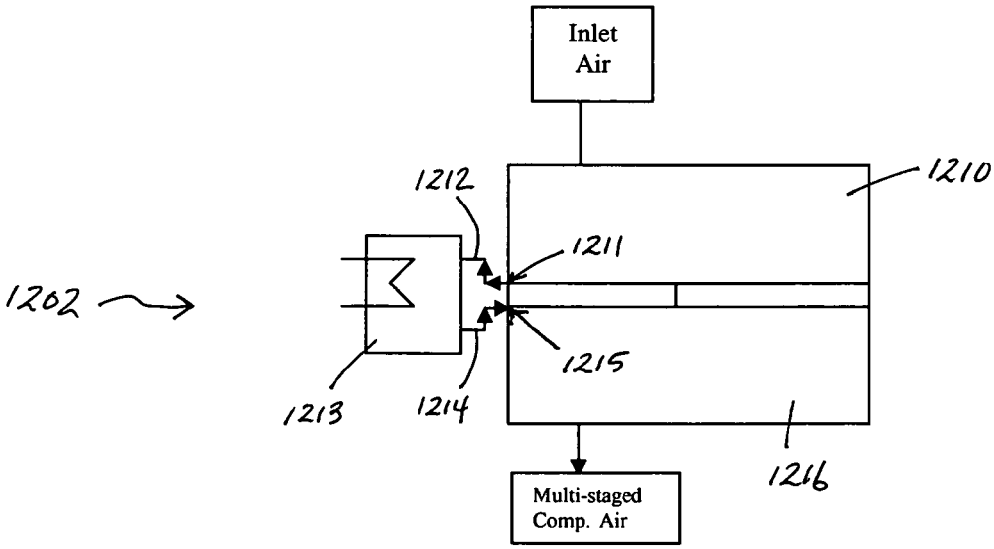

FIG. 12A and FIG. 12B schematically demonstrate two orientations for coupling TADCs of any variation, horizontally apposed 1201 (FIG. 12A) and horizontally aligned 1202 (FIG. 12B). When multistage compression is desired in the orientation shown in FIG. 12A, the gas discharge port 1204 of the first TADC 1203 can be connected via flow path 1205 to intercooler 1206, and via flow path 1207 to the gas intake port 1208 of the second TADC 1209. When multistage compression is desired in the orientation shown in FIG. 12B, the gas discharge port 1211 of the first TADC 1210 can be connected via flow path 1212 to intercooler 1213, and via flow path 1214 to the gas intake port 1215 of the second TADC 1216. The intercooler can reside in a number of different locations other than the location shown in FIG. 12A and FIG. 12B. Additional TADC(s) configured in a similar manner can be added to both configurations. Both orientations can also encompass alternate setups, such as having each compression housing on opposite ends. Finally, while not shown, multiple TADC units of any variation can feed into a single TADC.

As noted, the thermoacoustic prime mover in a TADC involves a hot and cold source. Heat can be delivered by any medium, such as copper wiring, preheated gas/fluid, which utilizes piping and possibly a pump, or some other combination/new variation thereof. Furthermore, a heat recovery unit (HRU)/exchanger or similar device can be used in conjunction with a hot source to facilitate the heating of gas/fluid for the thermoacoustic prime mover. As for cooling, a cool gas/fluid may be used. Furthermore; the gas/fluid may be circulated via a cooling system, which may include, but is not limited to, exchangers, fans, and pumps.

With slight modifications, most of the previously discussed single acting embodiments can be converted to double acting (and vice versa), non-lubricated can be converted to lubricated (and vice versa), and any type of thermoacoustic engine/housing can be used with any type of compression housing.

As noted earlier, a TADC of any variation can be used in conjunction with a gas turbine, which could power an on or offshore centrifugal compressor, an electrical generation set, or pump. The compressed air from a TADC may also be injected into an expander, which is attached to the external shaft of a gas turbine or a separate generation set providing onsite electricity. Additional TADC gas turbine applications include ships and tanks.

A gas/diesel engine (stationary or moving) is another type of engine that can utilize any variation of a TADC to convert waste heat (exhaust) to usable energy. For example, the compressed air could be injected into the engine's intake tract or used with multistage compression. Alternatively, the compressed air could be applied to an expander generation set, which could provide electricity to various electrical applications. One differentiating factor between a gas turbine and a gas/diesel engine is that a gas/diesel engine relies on engine coolant, which is considerably cooler than exhaust gas, to disperse heat. While the use of engine coolant reduces the amount of heat that can be harnessed via exhaust, the engine coolant could be used as a heat sink for the thermoacoustic engine (i.e., coolant could be pumped through the cold exchanger).

A TADC system of any variation also holds potential in the manufacturing environment. For example, in the coke/iron/steel industry a TADC could provide onsite compression or electricity (with expander generation set) by harnessing waste heat emitted from a coke oven, quenching tower, furnace/kiln, sintering plant, ultra high power electric arc furnace, or casting facility. Additional TADC compression/electrical applications in the metal industry include refining furnaces (includes ultra high power electric) in nickel, aluminum, zinc, and copper plants. Finally, a TADC can be used with a glass plant (furnace), cement plant (kiln), coal power plant, ammonia plant, carbon black plant, incinerator, catalytic cracker, drying and baking oven, and heat treating furnace. It is also important to note that all of these plants/systems emit flue gas. Generally, before this gas can be released into the atmosphere, the gas must be scrubbed of pollutants. However, the temperature of the gas is often too hot for the filters to operate; hence, water is used to cool the flue gas. A TADC system could be used in lieu of water, thus not only reducing the water consumption, but also improving the energy efficiency of the plant.

A TADC system of any variation also has potential in the alternative energy segment. For example, a TADC system could provide low cost compression or electricity (with an expander/generation set) to remote locations with access to geothermal energy (e.g., abandoned oil wells), thereby preventing costly construction of power lines and reducing wasted energy lost through transmission. Another example would be use of a TADC with solar concentrators, which could heat tubing containing a gas/fluid (e.g., thermal oil). As with geothermal applications, the heated gas/fluid could power the TADC. Finally, many types of fuel cells exhaust high grade heat, which could also be used with a TADC to generate additional compression or electricity (with expander/generation set).

All of the devices and methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the methods described herein without departing from the concept, spirit and scope of the invention. More specifically, it will be apparent that certain agents which are both chemically and physically related may be substituted for the agents described herein while the same or similar results would be achieved. All such similar substitutes and modifications apparent to those skilled in the art are deemed to be within the spirit, scope and concept of the invention as defined by the appended claims.

The invention claimed is:

1. A thermoacoustic compressor, comprising:

a) a first housing having a first end, a second end, an inner wall, and an outer wall, said first housing defining a first cavity, and said second end of said first housing defining a first piston rod aperture;

b) a second housing having a first end, a second end, an inner wall, and an outer wall, said first end of said second housing operably connected to said second end of said first housing, said second housing comprising pressurized gas or fluid and defining a second cavity, and said first end of said second housing defining a second piston rod aperture;

c) a reciprocating piston axially movable within said first and second cavities, said reciprocating piston comprising:

i) a compression piston head having a first end, a second end, and an outer wall, said compression piston head disposed in said first cavity, said first end of said compression piston head and said first end of said first housing defining a first variable-volume chamber, and said second end of said compression piston head and said second end of said first housing defining a second variable-volume chamber;

ii) a piston rod having a first end and a second end, said first end of said piston rod connected to said second end of said compression piston head; and iii) a resonating piston head having a first end, a second end, and an outer wall, said resonating piston head disposed in said second cavity, said first end of said resonating piston head and said first end of said second housing defining a third variable-volume chamber, and said second end of said resonating piston head and said second end of said second housing defining a fourth variable-volume chamber, said first end of said resonating piston head connected to said second end of said piston rod;

d) a valved intake port and a valved discharge port on said first end of said first housing;

e) a thermoacoustic engine connected to said inner wall of said second housing positioned between said second end of said resonating piston head and said second end of said second housing;

f) a means for inhibiting gas flow between said first and said second housing;

g) a means for providing or delivering heat to said thermoacoustic engine; and h) a means for removing heat from said thermoacoustic engine.

2. The thermoacoustic compressor of claim 1, wherein said compression piston head comprises at least a first sealing means disposed between said outer wall of said compression piston head and said inner wall of said first housing.

3. The thermoacoustic compressor of claim 1, wherein said compression piston head is lubricated.

4. The thermoacoustic compressor of claim 1, further comprising a displacement control and return means within said first housing.

5. The thermoacoustic compressor of claim 1, wherein said thermoacoustic engine comprises a thermoacoustic core.

6. The thermoacoustic compressor of claim 5, wherein said thermoacoustic core comprises a hot exchanger, a cold exchanger, and a stack.

7. The thermoacoustic compressor of claim 5, wherein said thermoacoustic engine core comprises a hot exchanger, a cold exchanger, and a regenerator.

8. The thermoacoustic compressor of claim 1, wherein said second housing comprises or defines a torus.

9. The thermoacoustic compressor of claim 1, further comprising a second valved intake port and a second valved discharge port on said second end of said first housing.

10. The thermoacoustic compressor of claim 1, further comprising a third housing having a first end, a second end, an inner wall, and an outer wall, said first end of said second housing operably connected to said second end of said third housing, said second end of said first housing operably connected to said first end of said third housing, said third housing defining a third cavity, said first end of said third housing defining a third piston rod aperture, and said second end of said third housing defining a fourth piston rod aperture.

11. The thermoacoustic compressor of claim 1, wherein said second housing further comprises a plurality of thermoacoustic engines in series.

12. The thermoacoustic compressor of claim 1, further comprising a gas or fluid bearing disposed in a clearance gap between said outer wall of said compression piston and said inner wall of said first housing.

13. The thermoacoustic compressor of claim 1, further comprising:

a) a third housing having a first end, a second end, an inner wall, and an outer wall, said third housing defining a third cavity, said second end of said third housing operably connected to said first end of said first housing, and said second end of said third housing defining a third piston rod aperture, and wherein said first end of said first housing defines a fourth piston rod aperture;

b) a second compression piston head having a first end, a second end, and an outer wall, said second compression piston head disposed in said third cavity, said first end of said second compression piston head and said first end of said third housing defining a fifth variable-volume chamber, and said second end of said second compression piston head and said second end of said third housing defining a sixth variable-volume chamber;

c) a second piston rod having a first end and a second end, said first end of said second piston rod connected to said first end of said compression piston head, and said second end of said second piston rod connected to said second end of said second compression piston head; and d) a second valved intake port and a second valved discharge port on said first end of said third housing.

14. A thermoacoustic compressor comprising:

a) a first housing having a first end, a second end, an inner wall, and an outer wall, said first housing defining a first cavity, and said second end of said first housing defining a first piston rod aperture;

b) a second housing having a first end, a second end, an inner wall, and an outer wall, said first end of said second housing operably connected to said second end of said first housing, said second housing comprising pressurized gas or fluid and defining a second cavity, and said first end of said second housing defining a second piston rod aperture;

c) a third housing having a first end, a second end, an inner wall, and an outer wall, said second end of said third housing operably connected to said first end of said first housing, said third housing comprising pressurized gas or fluid and defining a third cavity, and said second end of said third housing defining a third piston rod aperture;

d) a reciprocating piston axially movable within said first, second, and third cavities, said reciprocating piston comprising:

i) a compression piston head having a first end, a second end, and an outer wall, said compression piston head disposed in said first cavity, said first end of said compression piston head and said first end of said first housing defining a first variable-volume chamber, and said second end of said compression piston head and said second end of said first housing defining a second variable-volume chamber;

ii) a first piston rod having a first end and a second end, said first end of said first piston rod connected to said second end of said compression piston head;

iii) a first resonating piston head having a first end, a second end, and an outer wall, said first resonating piston head disposed in said second cavity, said first end of said first resonating piston head and said first end of said second housing defining a third variable-volume chamber, and said second end of said first resonating piston head and said second end of said second housing defining a fourth variable-volume chamber, said first end of said first resonating piston head connected to said second end of said first piston rod;

iv) a second piston rod having a first end and a second end, said second end of said second piston rod connected to said first end of said compression piston head; and v) a second resonating piston head having a first end, a second end, and an outer wall, said second resonating piston head disposed in said third cavity, said first end of said second resonating piston head and said first end of said third housing defining a fifth variable-volume chamber, and said second end of said second resonating piston head and said second end of said third housing defining a sixth variable-volume chamber, said second end of said second resonating piston head connected to said first end of said second piston rod;

e) a first valved intake port and a first valved discharge port on said first end of said first housing;

f) a first thermoacoustic engine connected to said inner wall of said second housing positioned between said second end of said first resonating piston head and said second end of said second housing;

g) a second thermoacoustic engine connected to said inner wall of said third housing positioned between said first end of said second resonating piston head and said first end of said third housing;

h) a means for inhibiting gas flow between said first and said second housing;

i) a means for inhibiting gas flow between said first and said third housing;

j) a means for providing or delivering heat to said first thermoacoustic engine;

k) a means for providing or delivering heat to said second thermoacoustic engine;

l) a means for removing heat from said first thermoacoustic engine; and m) a means for removing heat from said second thermoacoustic engine.

15. A method of compressing a fluid or gas, comprising:

a) introducing a fluid or gas through the valved intake port of the thermoacoustic compressor of claim 1 into the first variable-volume chamber of the first cavity;

b) running the thermoacoustic compressor of claim 1; thereby compressing said fluid or gas.

16. The method of claim 15, wherein said compressed fluid or gas is released from said first variable-volume chamber through said valved discharge port.

17. The method of claim 16, wherein said compressed fluid or gas is introduced into a separate mechanical device.

18. The method of claim 17, wherein said mechanical device is a gas turbine.

19. The method of claim 16, wherein heat is provided to said thermoacoustic engine from a separate mechanical device.

20. The method of claim 19, wherein said heat is waste heat generated by said separate mechanical device.

* * * * *